US011257646B2

(12) United States Patent
Harano et al.

(10) Patent No.: US 11,257,646 B2
(45) Date of Patent: Feb. 22, 2022

(54) CONTACT DEVICE, ELECTROMAGNETIC RELAY, AND ELECTRICAL DEVICE

(71) Applicant: Panasonic Intellectual Property Management Co., Ltd., Osaka (JP)

(72) Inventors: Tomokazu Harano, Mie (JP); Tatsuo Aratani, Osaka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 211 days.

(21) Appl. No.: 16/604,495

(22) PCT Filed: Apr. 4, 2018

(86) PCT No.: PCT/JP2018/014372
§ 371 (c)(1),
(2) Date: Oct. 10, 2019

(87) PCT Pub. No.: WO2018/190210
PCT Pub. Date: Oct. 18, 2018

(65) Prior Publication Data

US 2020/0161067 A1 May 21, 2020

(30) Foreign Application Priority Data

Apr. 14, 2017 (JP) ..... JP2017-080946

(51) Int. Cl.
*H01H 50/54* (2006.01)
*H01H 1/54* (2006.01)
(Continued)

(52) U.S. Cl.
CPC ..... *H01H 50/541* (2013.01); *H01H 1/54* (2013.01); *H01H 9/383* (2013.01); *H01H 9/386* (2013.01); *H01H 50/04* (2013.01)

(58) Field of Classification Search
CPC ..... H01H 1/06; H01H 1/54; H01H 50/04; H01H 50/14; H01H 50/38; H01H 50/541;
(Continued)

(56) References Cited

U.S. PATENT DOCUMENTS 4,467,301 A * 8/1984 Goodrich ..... H01H 1/54 335/195
2002/0135446 A1* 9/2002 Takano ..... H01H 50/642 335/128
(Continued)

FOREIGN PATENT DOCUMENTS

CN 205828280 U 12/2016
EP 1246214 A2 10/2002
(Continued)

OTHER PUBLICATIONS

International Search Report issued in corresponding International Patent Application No. PCT/JP2018/014372, dated Jun. 26, 2018, with English translation.
(Continued)

*Primary Examiner* — Bernard Rojas
(74) *Attorney, Agent, or Firm* — McDermott Will & Emery LLP

(57) ABSTRACT

A contact device includes a moving contactor, a pair of moving contacts arranged in one direction, a pair of fixed terminals, and a pair of fixed contacts. At least one fixed terminal, selected from the pair of fixed terminals, includes a contact holder. The contact holder includes a first fixed extension and a second fixed extension. As for either a current component flowing in the one direction into the fixed contact or a current component flowing in the one direction out of the fixed contact, the current component flowing through the first fixed extension has a larger amount of current than a current component flowing through the second fixed extension.

12 Claims, 11 Drawing Sheets

(51) Int. Cl.
*H01H 50/04* (2006.01)
*H01H 9/38* (2006.01)

(58) Field of Classification Search
CPC ..... H01H 50/546; H01H 9/34; H01H 9/383; H01H 9/386
See application file for complete search history.

(56) References Cited

U.S. PATENT DOCUMENTS

| | | | | |
|---|---|---|---|---|
| 2016/0372286 | A1 | 12/2016 | Kubono et al. | |
| 2018/0166240 | A1* | 6/2018 | Daikoku | H01H 50/58 |
| 2018/0182584 | A1* | 6/2018 | Iwamoto | H01H 9/443 |
| 2019/0355536 | A1* | 11/2019 | Ozaki | H01H 50/14 |

FOREIGN PATENT DOCUMENTS

| | | | |
|---|---|---|---|
| JP | H03-110725 | A | 5/1991 |
| JP | H05-006644 | U | 1/1993 |
| JP | H10-56250 | A | 2/1998 |
| JP | 2002-334964 | A | 11/2002 |
| JP | 2010-123545 | A | 6/2010 |
| JP | 2014-154496 | A | 8/2014 |

OTHER PUBLICATIONS

Extended European Search Report issued in corresponding European Patent Application No. 18784130.9, dated Mar. 17, 2020.
Chinese Office Action and Search Report issued in corresponding Chinese Patent Application No. 201880024760.2, dated May 7, 2021, with English translation.

* cited by examiner

CONTACT DEVICE, ELECTROMAGNETIC RELAY, AND ELECTRICAL DEVICE

CROSS-REFERENCE OF RELATED APPLICATIONS

This application is the U.S. National Phase under 35 U.S.C. § 371 of International Patent Application No. PCT/JP2018/014372, filed on Apr. 4, 2018, which in turn claims the benefit of Japanese Application No. 2017-080946, filed on Apr. 14, 2017, the entire disclosures of which Applications are incorporated by reference herein.

TECHNICAL FIELD

The present invention generally relates to a contact device, an electromagnetic relay, and an electrical device, and more particularly relates to a contact device, an electromagnetic relay, and an electrical device, all of which are configured to cut off a large current.

BACKGROUND ART

Various types of electromagnetic relays have been proposed in the art (see, for example, Patent Literature 1). Patent Literature 1 describes an electromagnetic relay including at least two pairs of contacts, each consisting of a fixed contact and a moving contact which are designed to open and close by being driven by an electromagnetic mechanism. In electromagnetic relay of Patent Literature 1, the at least two pairs of contacts are provided so as to be spaced apart from each other.

Recently, an electromagnetic relay with large capacity has been provided. Such a large-capacity electromagnetic relay comes to have a large contact current. Therefore, when an arc is generated between the fixed contact and moving contact thereof, the contact members of the fixed contact and moving contact are either worn or melted to deteriorate the contacts, thus possibly causing some instability in the operation of the electromagnetic relay.

CITATION LIST

Patent Literature

Patent Literature 1: JP 2010-123545 A

SUMMARY OF INVENTION

In view of the foregoing background, it is therefore an object of the present invention to provide a contact device, an electromagnetic relay, and an electrical device, all of which are configured to reduce the deterioration of the fixed and moving contacts by accelerating the movement of an arc generated.

A contact device according to an aspect of the present invention includes: a moving contactor; a pair of moving contacts provided for the moving contactor and arranged side by side in one direction; a pair of fixed terminals arranged side by side in the one direction to face the moving contactor; and a pair of fixed contacts provided for the pair of fixed terminals, respectively. The moving contactor moves back and forth between a closed position where the pair of moving contacts are in contact with the pair of fixed contacts, respectively, and an open position where the pair of moving contacts are out of contact with the pair of fixed contacts, respectively. At least one fixed terminal, selected from the pair of fixed terminals, includes a contact holder facing the moving contactor in a direction in which the closed position and the open position are connected together. The contact holder includes: a first fixed extension protruding, in the one direction, from the fixed contact of the one fixed terminal toward the other fixed terminal; and a second fixed extension protruding from the fixed contact away from the other fixed terminal. As for either a current component flowing in the one direction into the fixed contact or a current component flowing in the one direction out of the fixed contact, the current component flowing through the first fixed extension has a larger amount of current than a current component flowing through the second fixed extension.

An electromagnetic relay according to another aspect of the present invention includes: the contact device described above; and an electromagnetic device including a coil. The moving contactor is displaced depending on whether the coil is exited or not.

An electrical device according to still another aspect of the present invention includes: an electromagnetic relay; and a board to mount the electromagnetic relay thereon. The electromagnetic relay includes: the contact device described above; and an electromagnetic device including a coil and configured to displace the moving contactor depending on whether the coil is excited or not.

DESCRIPTION OF EMBODIMENTS

Note that embodiments and their variations to be described below are only examples of the present invention and should not be construed as limiting. Rather, those embodiments and variations may be readily modified in various manners, depending on a design choice or any other factor, without departing from a true spirit and scope of the present invention.

(Embodiments)

An electromagnetic relay 1 according to an exemplary embodiment will be described with reference to FIGS. 1A-6.

In the following description, the direction in which two moving contacts 11 (11*a*, 11*b*) and two fixed contacts 14, 15 face each other will be hereinafter referred to as a "rightward/leftward direction." A longitudinal direction along the length of fixed terminals 12, 13 will be hereinafter referred to as an "upward/downward direction" (see FIGS. 1A, 1B, and 2).

In the following description, the upward/downward direction will be hereinafter also referred to as a "first axis direction," the rightward/leftward direction will be hereinafter also referred to as a "second axis direction," and the direction perpendicular to both the first axis direction and the second axis direction will be hereinafter also referred to as a "third axis direction."

Note that even though arrows indicating these directions (namely, upward, downward, leftward, and rightward directions) are shown in FIGS. 2-4B, these arrows are just shown there as an assistant to description and are insubstantial ones. It should also be noted that these directions do not define how the electromagnetic relay 1 according to this embodiment should be used.

<Overall Configuration of this Embodiment>

Figure 2:
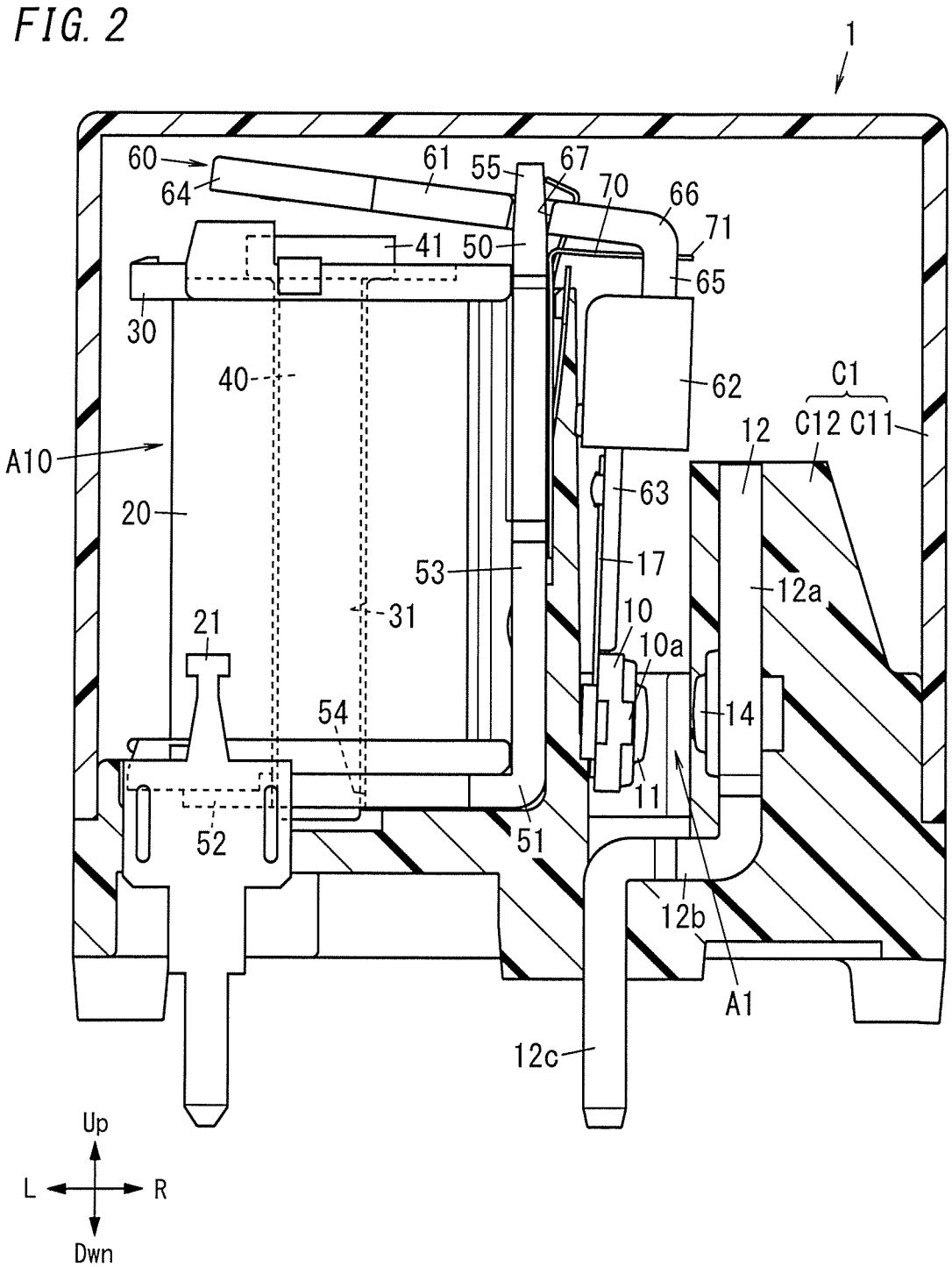
FIG. 2 is a cross-sectional view of the electromagnetic relay.
Figure 3:
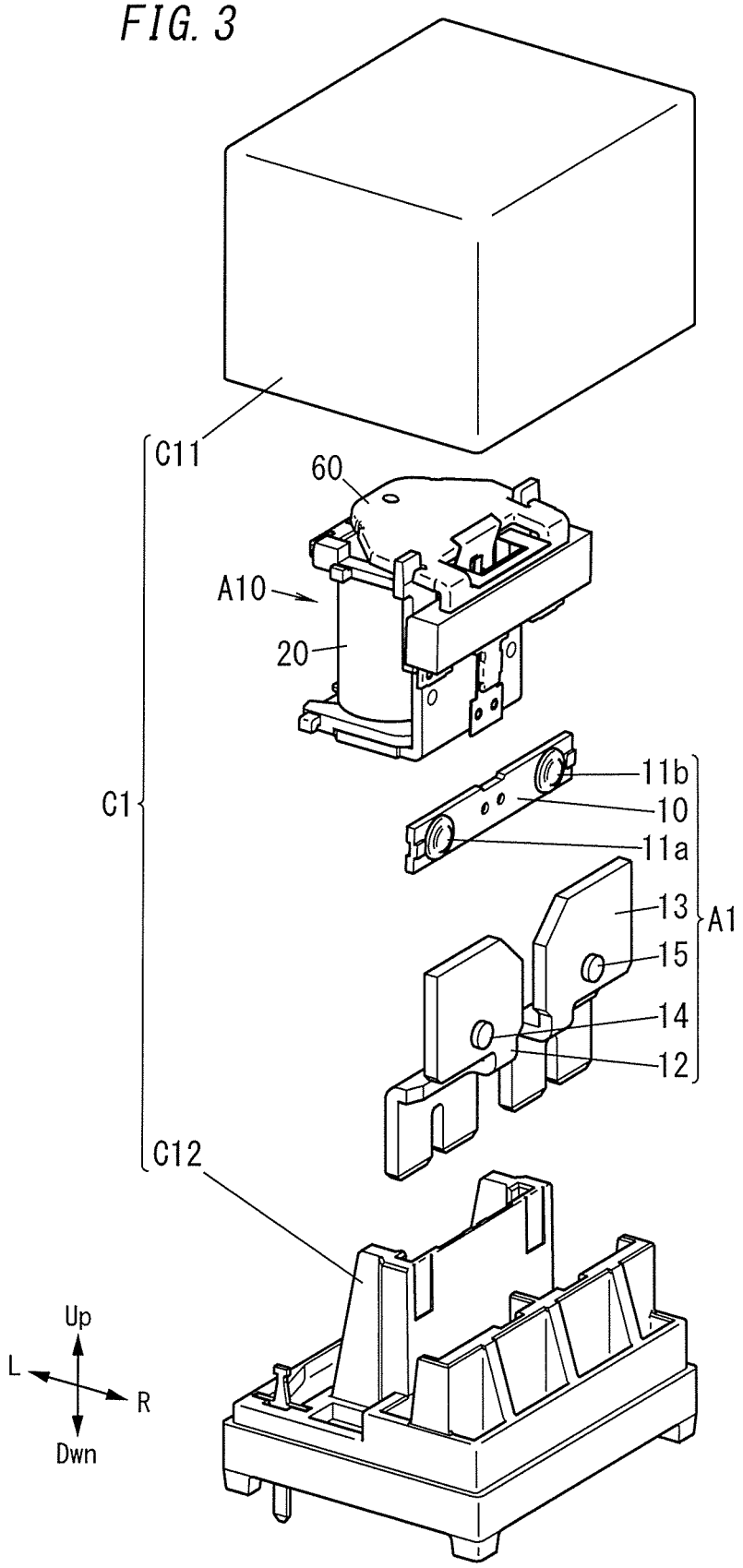
FIG. 3 is an exploded perspective view of the electromagnetic relay.

As shown in FIGS. 2 and 3, the electromagnetic relay 1 includes a moving contactor 10, two fixed terminals 12, 13, a coil 20, and an armature 60.

The moving contactor 10 includes two moving contacts 11 (11*a*, 11*b*). Note that when the two moving contacts 11 need to be distinguished from each other, the moving contacts 11 will be hereinafter referred to as a "moving contact 11*a*" and a "moving contact 11*b*," respectively.

The fixed terminals 12, 13 include fixed contacts 14, 15, respectively. The fixed contact 14 of the fixed terminal's 12 faces the moving contact 11*a* in the rightward/leftward direction. The fixed contact 15 of the fixed terminal's 13 faces the moving contact 11*b* in the rightward/leftward direction.

The moving contacts 11*a*, 11*b* move back and forth between a closed position where the moving contacts 11*a*, 11*b* are respectively in contact with the fixed contacts 14, 15 that the moving contacts 11*a*, 11*b* respectively face and an open position where the moving contacts 11*a*, 11*b* are out of contact with the fixed contacts 14, 15, respectively.

Turning the moving contactor 10 around the third axis direction as an axis of rotation allows the moving contacts 11*a*, 11*b* to move back and forth between the closed position and the open position.

Energizing the coil 20 causes electromagnetic force to be generated between the armature 60 and an iron core 40 (to be described later) and between the armature 60 and a yoke 50 (to be described later). This electromagnetic force causes the armature 60 to be displaced. As the armature 60 rotates, the moving contactor 10 is displaced, i.e., turns around the third axis direction as an axis of rotation.

The fixed terminal 12 is electrically connected to one terminal of an AC power supply, and the fixed terminal 13 is electrically connected to the other terminal of the AC power supply. An external device is connected either between the fixed terminal 12 and the AC power supply or between the fixed terminal 13 and the AC power supply.

Next, the electromagnetic relay 1 according to this embodiment will be described in detail.

The electromagnetic relay 1 according to this embodiment may be used as a device for shutting down a circuit through which an AC current of about 100 A flows, e.g., as a parallel-off relay provided for a power conditioner. Note that this numerical value is only an example and should not be construed as limiting. The electromagnetic relay 1 according to this embodiment is able to start and stop supplying power from the AC power supply to the external device by opening and closing the contact device A1 (to be described later).

The electromagnetic relay 1 according to this embodiment is a single stable relay, which is a type of a so-called "hinged relay." The electromagnetic relay 1 according to this embodiment includes the contact device A1, an electromagnetic device A10 (drive mechanism), and a case C1 as shown in FIGS. 2 and 3.

<Description of Contact Device A1>

The contact device A1 includes the moving contactor 10 provided with the two moving contacts 11 and a fixed member 16 as shown in FIG. 3.

The fixed member 16 includes the fixed terminal 12 with the fixed contact 14 and the fixed terminal 13 with the fixed contact 15. The fixed terminals 12 and 13 are arranged side by side in the third axis direction (see FIGS. 1B and 2).

The moving contactor 10 and the fixed terminals 12, 13 are arranged to face each other in the rightward/leftward direction as described above (see FIGS. 1B and 2).

In this embodiment, the pair of moving contacts 11 have a circular shape when viewed in the rightward/leftward direction and are formed in a shape with multiple steps (e.g., two steps in this embodiment), of which the diameter decreases toward the fixed contacts 14, 15 that the moving contacts 11 face. In this embodiment, the moving contacts 11 each include a tip portion 110, which has a circular shape when viewed in the rightward/leftward direction, and a retracted portion 111, of which the diameter is larger than that of the tip portion 110 (see FIG. 1B).

The fixed contacts 14, 15 also have a circular shape when viewed in the rightward/leftward direction and are formed in a shape with multiple steps (e.g., two steps in this embodiment), of which the diameter decreases toward the moving contacts 11 that the fixed contacts 14, 15 face. In this embodiment, the fixed contact 14 (15) also includes a tip portion 140 (150), which has a circular shape when viewed in the rightward/leftward direction, and a retracted portion 141 (151), of which the diameter is larger than that of the tip portion 140 (150).

Figure 4A:
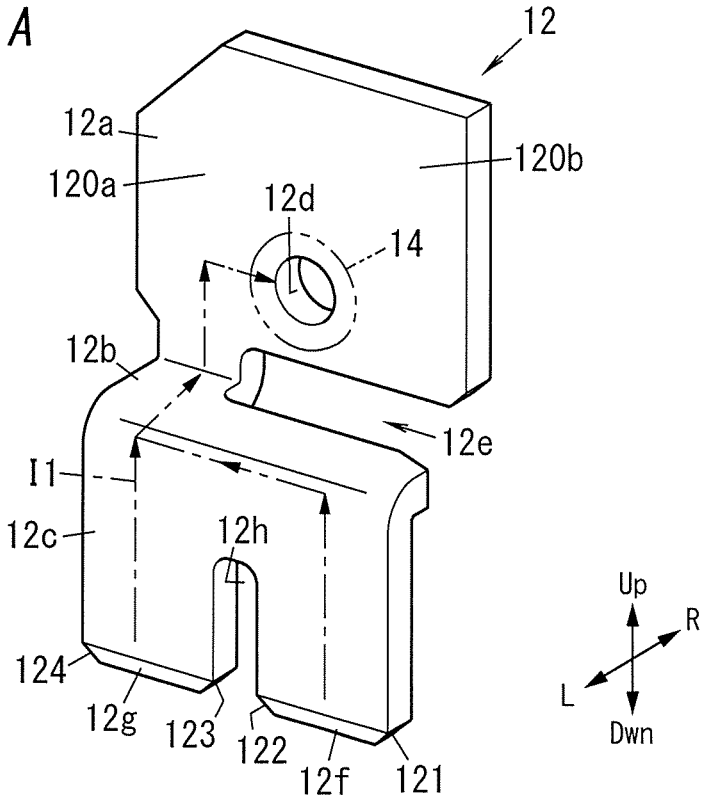
FIGS. 4A and 4B illustrate shapes of fixed terminals provided for the electromagnetic relay.

The fixed terminal 12 is made of a conductive material (e.g., a copper alloy) and includes a first terminal portion 12*a* (contact holder) extending parallel to the upward/downward direction and a having a flat plate shape, a second terminal portion 12*b* extending parallel to the rightward/leftward direction and a having a flat plate shape, and a third terminal portion 12*c* (extended portion) extending parallel to the upward/downward direction and a having a flat plate shape (see FIG. 4A). The first terminal portion 12*a* and the third terminal portion 12*c* are continuous with each other via the second terminal portion 12*b*. The tip of the first terminal portion 12*a* is located over the second terminal portion 12*b*, and the tip of the third terminal portion 12*c* is located under the second terminal portion 12*b*.

Figure 4B:
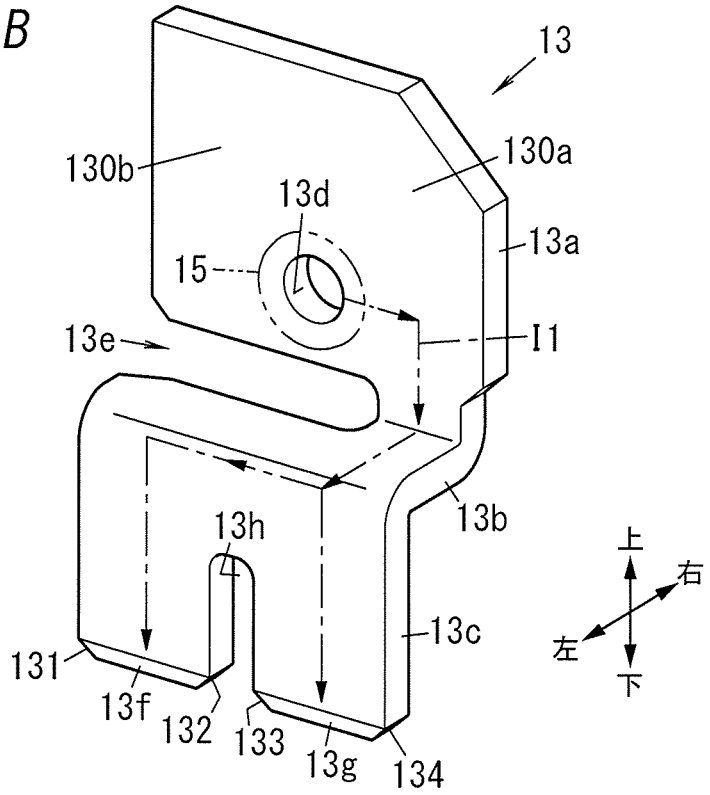
Figure 5A:
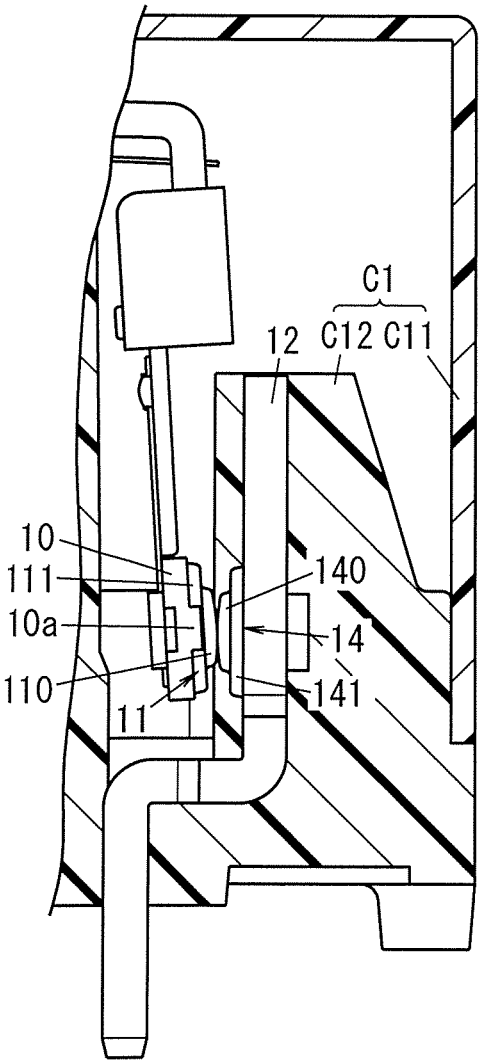
FIG. 5A is a cross-sectional view, illustrating an ON state of a contact device, of a part of the electromagnetic relay.
Figure 5B:
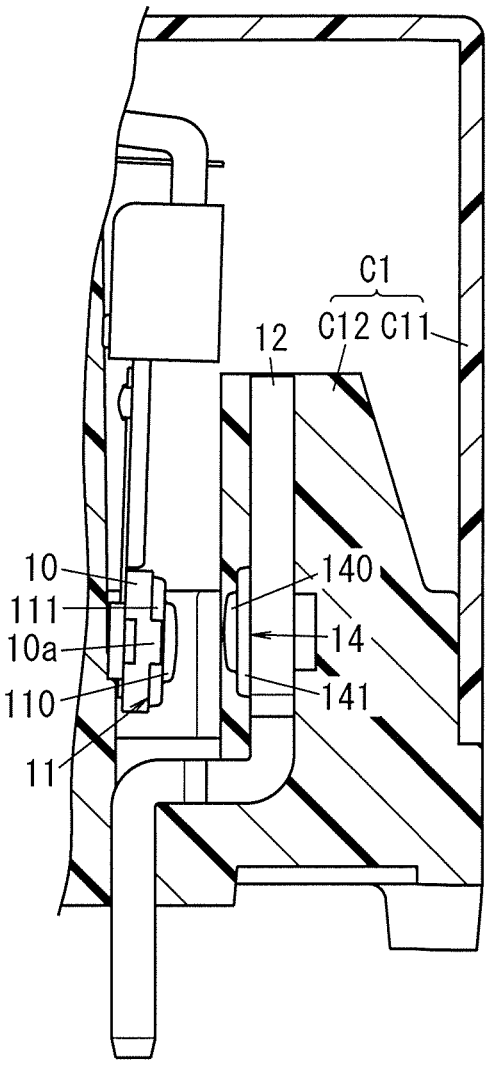
FIG. 5B is a cross-sectional view, illustrating an OFF state of the contact device, of the part of the electromagnetic relay.

The fixed terminal 13 is made of a conductive material (e.g., a copper alloy) and includes a first terminal portion 13*a* (contact holder) extending parallel to the upward/downward direction and a having a flat plate shape, a second terminal portion 13*b* extending parallel to the rightward/leftward direction and a having a flat plate shape, and a third terminal portion 13*c* (extended portion) extending parallel to the upward/downward direction and a having a flat plate shape (see FIG. 4B). The first terminal portion 13*a* and the third terminal portion 13*c* are continuous with each other via the second terminal portion 13*b*. The tip of the first terminal portion 13*a* is located over the second terminal portion 13*b*, and the tip of the third terminal portion 13*c* is located under the second terminal portion 13*b*.

The first terminal portion 12*a* of the fixed terminal 12 has an opening 12*d*. The fixed contact 14 is secured onto the fixed terminal 12 by fitting the fixed contact 14 into the opening 12*d* to make the fixed contact 14 pass through the opening 12*d* and then caulking the fixed contact 14 and the first terminal portion 12*a* together. The first terminal portion 13*a* of the fixed terminal 13 has an opening 13*d*. The fixed contact 15 is secured onto the fixed terminal 13 by fitting the fixed contact 15 into the opening 13*d* to make the fixed contact 15 pass through the opening 13*d* and then caulking the fixed contact 15 and the first terminal portion 13*a* together. The first terminal portion 12*a* of the fixed terminal 12 and the first terminal portion 13*a* of the fixed terminal 13 face the direction in which the moving contactor 10 (or the moving contacts 11) moves (see FIG. 1B). Optionally, the fixed contact 14 may form an integral part of the fixed terminal 12. Likewise, the fixed contact 15 may also form an integral part of the fixed terminal 13.

The fixed terminal 12 has a partially cutout portion 12*e* between the first terminal portion 12*a* and the second terminal portion 12*b*. Likewise, the fixed terminal 13 also has a partially cutout portion 13*e* between the first terminal portion 13*a* and the second terminal portion 13*b*.

The fixed terminal 12 further includes: a first fixed extension 120*a* protruding in the third axis direction from the fixed contact 14 of the fixed terminal 12 toward the fixed terminal 13 (i.e., inward); and a second fixed extension 120*b* protruding in the third axis direction from the fixed contact 14 of the fixed terminal 12 away from the fixed terminal 13 (i.e., outward). Likewise, the fixed terminal 13 further includes: a first fixed extension 130*a* protruding in the third axis direction from the fixed contact 15 of the fixed terminal 13 toward the fixed terminal 12 (i.e., inward); and a second fixed extension 130*b* protruding in the third axis direction from the fixed contact 15 of the fixed terminal 13 away from the fixed terminal 12 (i.e., outward).

Since the fixed terminal 12 has the cutout portion 12*e*, the third terminal portion 12*c* of the fixed terminal 12 is electrically connected to the second fixed extension 120*b* via the second terminal portion 12*b* and the first fixed extension 120*a*. Likewise, since the fixed terminal 13 has the cutout portion 13*e*, the third terminal portion 13*c* of the fixed terminal 13 is electrically connected to the second fixed extension 130*b* via the second terminal portion 13*b* and the first fixed extension 130*a*.

The moving contactor 10 is made of a conductive material (e.g., a copper alloy). The moving contactor 10 is formed in the shape of a flat plate, of which the length is defined in the third axis direction. The moving contactor 10 is provided with the two moving contacts 11 (11*a*, 11*b*) which are arranged side by side in the third axis direction (see FIGS. 1B and 2). The moving contacts 11*a*, 11*b* face the fixed contacts 14, 15, respectively (see FIGS. 1B and 2). The moving contactor 10 has two fixing holes, which are arranged side by side in the middle of the third axis direction. The moving contacts 11*a*, 11*b* are secured onto the moving contactor 10 by respectively fitting the moving contacts 11*a*, 11*b* into one and the other of the two fixing holes to make the moving contacts 11*a*, 11*b* to pass through the fixing holes and caulking the moving contacts 11*a*, 11*b* and the moving contactor 10 together. Alternatively, the moving contacts 11*a*, 11*b* may form integral parts of the moving contactor 10.

Figure 1B:
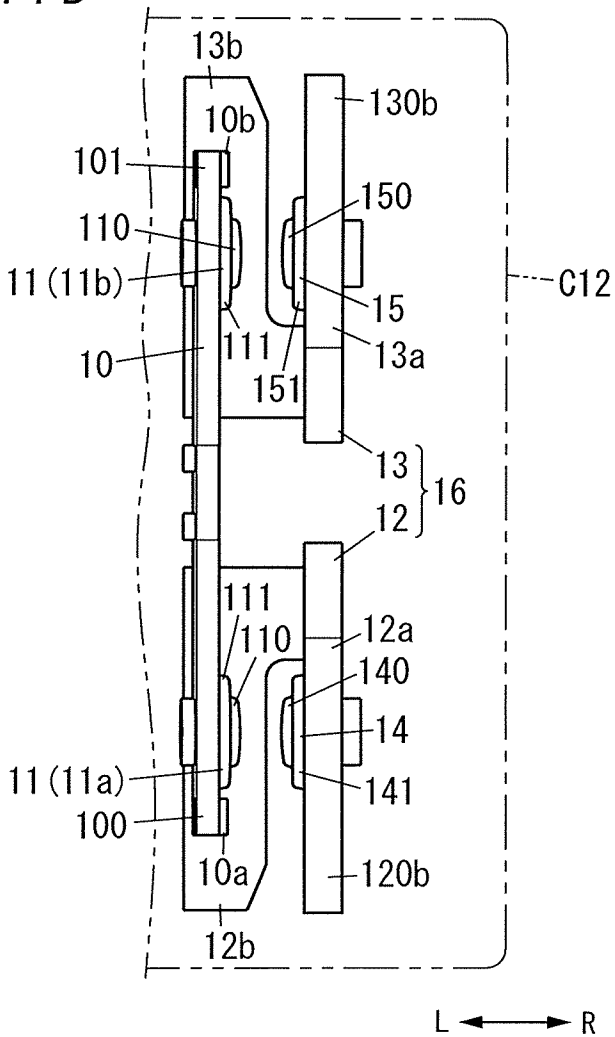
FIG. 1B is a cross-sectional view illustrating the electromagnetic relay when a part of the relay is viewed in plan.

The moving contactor 10 includes moving extensions 100, 101 protruding in the third axis direction on both sides of the pair of moving contacts 11 (see FIG. 1B). The moving extension 100 faces the second fixed extension 120*b*, and the moving extension 101 faces the second fixed extension 130*b*.

The moving extension 100 includes a protrusion 10*a* protruding in the rightward/leftward direction toward the fixed terminal 12 (fixed member 16). The moving extension 101 includes a protrusion 10*b* protruding in the rightward/leftward direction toward the fixed terminal 13 (fixed member 16). Specifically, the protrusion 10*a* is arranged in the middle of the width (corresponding to the upward/downward direction) of the moving contactor 10 (moving extension 100). Likewise, the protrusion 10*b* is arranged in the middle of the width (corresponding to the upward/downward direction) of the moving contactor 10 (moving extension 101). Alternatively, the protrusions 10*a*, 10*b* may be each arranged closer to a side surface with respect to the middle of the width of the moving contactor 10. In this embodiment, the protrusions 10*a*, 10*b* have a prismatic shape. The dimension as measured in the rightward/leftward direction of the protrusion 10*a* (i.e., the height of the protrusion 10*a*) is smaller than the dimension as measured in the rightward/leftward direction of the moving contact 11*a* protruding from the moving contactor 10 toward the fixed member 16. Likewise, the dimension as measured in the rightward/leftward direction of the protrusion 10*b* (i.e., the height of the protrusion 10*b*) is smaller than the dimension as measured in the rightward/leftward direction of the moving contact 11*b* protruding from the moving contactor 10 toward the fixed member 16. The protrusions 10*a*, 10*b* and the moving contactor 10 form respective parts of the same member. That is to say, the protrusions 10*a*, 10*b* may be made of a conductive material such as a copper alloy.

The moving contactor 10 turns around the third axis direction as an axis of rotation as the electromagnetic device A10 operates. This turn of the moving contactor 10 causes the two moving contacts 11*a*, 11*b* to move between the closed position and the open position. As used herein, the closed position is a position where each moving contact 11 is in contact with the fixed contact 14 or 15 that the moving contact 11 faces. The open position is a position where each moving contact 11 is out of contact with the fixed contact 14 or 15 that the moving contact 11 faces.

When the pair of moving contacts 11 is in the closed position (i.e., when the contact device A1 is ON), the fixed terminals 12 and 13 are short-circuited with each other via the moving contactor 10. Thus, when the contact device A1 is ON, the fixed terminals 12 and 13 are electrically conductive with each other and AC power is supplied from the AC power supply to the external device. On the other hand, when the pair of moving contacts 11 is in the open position (i.e., when the contact device A1 is OFF), the fixed terminals 12 and 13 are electrically unconductive with each other. Thus, no AC power is supplied from the AC power supply to the external device.

<Description of Electromagnetic Device A10>

As shown in FIGS. 1 and 2, the electromagnetic device A10 includes the coil 20, a bobbin 30, an iron core 40, a yoke 50, the armature 60, and a hinge spring 70. The iron core 40, the yoke 50, and a magnetic pole piece 61 (to be described later) of the armature 60 are all made of a magnetic material (such as electromagnetic soft iron). FIG.

1A is a perspective view of the electromagnetic relay 1 from which a cover C11 (to be described later) is removed.

The coil 20 is formed by winding an electric wire (such as a copper wire) clockwise (when viewed from over the coil 20) around an outer peripheral surface of the bobbin 30. The coil 20 consists of the electric wire wound around the outer peripheral surface of the bobbin 30. The coil 20 further includes two coil terminals 21, 22 as shown in FIG. 1A. One end of the winding is electrically connected to the coil terminal 21, and the other end thereof is electrically connected to the coil terminal 22.

Applying voltage between the coil terminals 21 and 22 allows the coil 20 to be supplied with a current via the coil terminals 21 and 22, thus generating a magnetic flux.

The bobbin 30 is made of a material with electrical insulation properties such as a synthetic resin material and formed in a cylindrical shape. The bobbin 30 is arranged such that its axis is aligned with the upward/downward direction.

The iron core 40 is formed in the shape of a column elongated in the upward/downward direction. The iron core 40 is inserted into a hollow portion 31 of the bobbin 30 with both longitudinal ends (i.e., both ends in the upward/downward direction) thereof exposed out of the bobbin 30. A first longitudinal end portion (i.e., an upper end portion) of the iron core 40 has a larger diameter than a middle portion thereof, and faces the armature 60. In the following description, the first end portion of the iron core 40 will be hereinafter referred to as an "iron core attracting portion 41." On the other hand, a second longitudinal end portion (lower end portion) of the iron core 40 is inserted into an insertion hole 54 cut through a first plate 52 (to be described later) of the yoke 50, and integrated with the first plate 52 by caulking.

The yoke 50 is formed to have an L-cross section by having a middle portion 51 of a rectangular plate, elongated in the upward/downward direction, folded to the left. The yoke 50 consists of a first plate 52 and a second plate 53. The yoke 50 forms, along with the iron core 40 and the magnetic pole piece 61 of the armature 60, a magnetic path for the magnetic flux, generated when the coil 20 is energized, to pass through. Each of the first plate 52 and second plate 53 is formed in a rectangular plate shape. The first plate 52 is provided for one end (i.e., the lower end) along the axis (upward/downward direction) of the coil 20. The first plate 52 has the insertion hole 54 running through the thickness thereof (in the upward/downward direction). The second end portion of the iron core 40 is inserted into the insertion hole 54 and integrated by caulking. The second plate 53 is provided on the right of the coil 20.

The armature 60 includes the magnetic pole piece 61, an insulating portion 62, and a fixed piece 63. The magnetic pole piece 61 is formed to have an L-cross section by having a middle portion 66 of a rectangular plate, elongated in the rightward/leftward direction, folded downward. The magnetic pole piece 61 includes a first plate 64 and a second plate 65. Each of the first plate 64 and the second plate 65 is formed in the shape of a rectangular plate. The tip of the first plate 64 of the magnetic pole piece 61 faces the iron core attracting portion 41, which forms part of the iron core 40 as shown in FIG. 2. The first plate 64 has cutout portions 67 at both ends thereof. A pair of clamping pieces 55 protruding from both ends of the tip of the second plate 53 of the yoke 50 are engaged with the cutout portions 67 and are supported so as to be freely swingable. The second plate 65 is joined to the insulating portion 62.

The fixed piece 63 is joined to the insulating portion 62 so as to protrude downward. The moving contactor 10 is joined to a moving spring 17 joined to the fixed piece 63. That is to say, the moving contactor 10 is joined to the armature 60 via the moving spring 17.

The armature 60 is configured to turn, around points where the armature 60 is engaged with the pair of clamping pieces 55 of the yoke 50 as a pair of fulcrums, between a first position where the first plate 64 is in contact with the iron core attracting portion 41 and a second position where the first plate 64 is out of contact with the iron core attracting portion 41 of the iron core 40.

The first plate 64 of the armature 60 is attracted toward, or released from, the iron core attracting portion 41 of the iron core 40 by the electromagnetic force generated when the coil 20 is energized. When the armature 60 is attracted toward the iron core attracting portion 41 of the iron core 40 (i.e., when the armature 60 is displaced from the second position to the first position), the second plate 65, the insulating portion 62, and the fixed piece 63 are displaced to the right. As the second plate 65, the insulating portion 62, and the fixed piece 63 are displaced to the right, the moving contactor 10 is also displaced to the right. On the other hand, when the armature 60 is released from the iron core attracting portion 41 of the iron core 40 (i.e., when the armature 60 is displaced from the first position to the second position), the second plate 65, the insulating portion 62, and the fixed piece 63 are displaced to the left. As the second plate 65, the insulating portion 62, and the fixed piece 63 are displaced to the left, the moving contactor 10 is also displaced to the left.

The hinge spring 70 is arranged between the yoke 50 and the armature 60. The hinge spring 70 includes a spring piece 71 that downwardly presses an upper part of the insulating portion 62 of the armature 60. The spring piece 71 downwardly pressing the upper part of the insulating portion 62 keeps the first plate 64 of the armature 60 out of contact with the iron core attracting portion 41 of the iron core 40 while the coil 20 is not energized. While the coil 20 is energized, the magnetic force of the iron core attracting portion 41 of the iron core 40 overcomes the pressing force of the spring piece 71 to bring the first plate 64 of the armature 60 into contact with the iron core attracting portion 41 of the iron core 40.

Next, the case C1 will be described.

The case C1 may be made of a material with electrical insulation properties such as a synthetic resin. The case C1 may be formed by fitting the cover C11 to the base C12 via engaging pieces, for example, or by bonding the cover C11 and the base C12 with a thermosetting resin adhesive, for example. The case C1 houses the contact device A1 and the electromagnetic device. As shown in FIG. 2, the tip of the third terminal portion 12*c* of the fixed terminal 12 and the tip of the third terminal portion 13*c* of the fixed terminal 13 of the contact device A1 are exposed out of the lower surface of the base C12. In addition, as shown in FIG. 2, respective parts of the coil terminals 21, 22 of the electromagnetic device A10 are exposed out of the lower surface of the base C12.

<Description of Operation of Electromagnetic Relay 1>

Next, it will be described how the electromagnetic relay 1 according to this embodiment operates. In the following description, the state of the moving contactor 10 when the contact device A1 is OFF will be hereinafter referred to as an "original state."

Energizing the winding of the coil 20 when the contact device Al is in OFF state causes the coil 20 to generate a magnetic flux. This increases the strength of the magnetic flux between the first plate 64 of the magnetic pole piece 61 of the armature 60 and the iron core attracting portion 41 of the iron core 40. As a result, the first plate 64 and the iron core attracting portion 41 attract each other with strong magnetic attraction. This causes the magnetic pole piece 61 to turn counterclockwise to move from the second position to the first position. As the magnetic pole piece 61 moves to the first position, the second plate 65 of the magnetic pole piece 61, the insulating portion 62, and the fixed piece 63 move to the right. At this time, the second plate 65 of the magnetic pole piece 61, the insulating portion 62, and the fixed piece 63 rotate counterclockwise around the third axis direction as an axis of rotation. This causes the moving contactor 10 to move to the right, i.e., turn counterclockwise around the third axis direction as an axis of rotation. As a result, the moving contactor 10 is displaced to the right, thus moving the moving contacts 11*a*, 11*b* to the closed position where the moving contacts 11*a*, 11*b* respectively come into contact with the fixed contacts 14, 15 that the moving contacts 11*a*, 11*b* respectively face (see FIG. 5A). This turns the contact device Al ON to make the fixed terminals 12, 13 electrically conductive with each other.

Next, de-energizing the winding of the coil 20 when the contact device Al is in ON state causes the magnetic flux generated by the coil 20 to disappear. Thus, the pressing force applied by the spring piece 71 of the hinge spring 70 presses an upper part of the insulating portion 62 of the armature 60 downward. This causes the magnetic pole piece 61 of the armature 60 to turn clockwise to move from the first position to the second position. As the magnetic pole piece 61 moves to the second position, the second plate 65 of the magnetic pole piece 61, the insulating portion 62, and the fixed piece 63 move to the left. At this time, the second plate 65 of the magnetic pole piece 61, the insulating portion 62, and the fixed piece 63 rotate clockwise around the third axis direction as an axis of rotation. This causes the moving contactor 10 to move to the left. As a result, the moving contactor 10 changes from the state of being displaced to the right into the "original state," thus moving the moving contacts 11*a*, 11*b* to the open position where the moving contacts 11*a*, 11*b* respectively go out of contact with the fixed contacts 14, 15 that the moving contacts 11*a*, 11*b* respectively face (see FIG. 5B). This turns the contact device A1 OFF to make the fixed terminals 12, 13 electrically disconnected from, and unconductive with, each other.

<Description of Cutoff Ability>

When the contact device A1 turns from ON to OFF, an arc is generated between the moving contact 11*a* and the fixed contact 14 and between the moving contact 11*b* and the fixed contact 15. Then, the contact device A1 of this embodiment moves the arc from between the contacts. The arc thus moved is cut off because the AC voltage that has been applied goes zero. Even if a high voltage is applied, or a large current flows, between the moving contact 11*a* and the fixed contact 14 and between the moving contact 11*b* and the fixed contact 15, the electromagnetic relay 1 moves the arc that has been generated between the contacts and stagnated on the contacts away from the contacts, thus reducing the deterioration of the surface of the contacts. That is to say, this improves the reliability of the electromagnetic relay 1.

In the following description, a situation where a current I1 flows from the fixed terminal 12 into the fixed terminal 13 through the moving contactor 10 will be described as an example.

Figure 6:
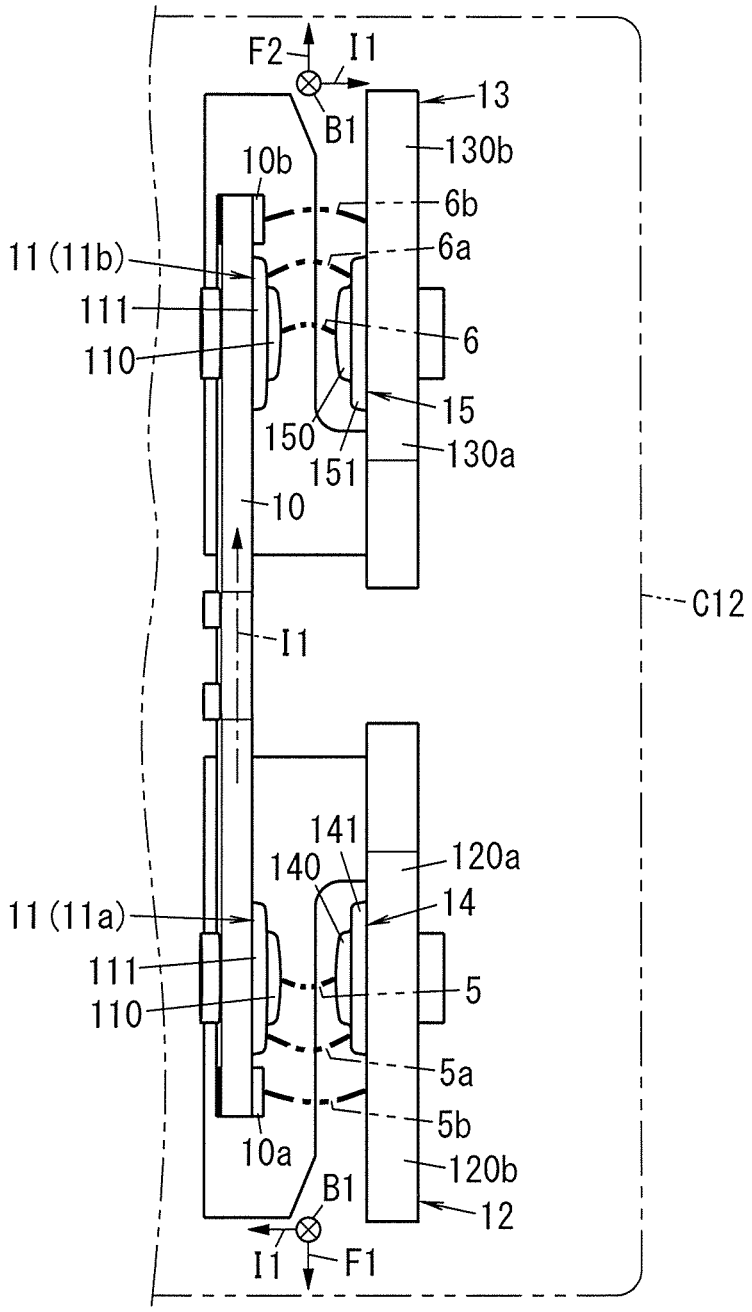
FIG. 6 is a cross-sectional view, illustrating how an arc moves, of the electromagnetic relay when a part of the relay is viewed in plan.

In that case, in the moving contactor 10, the current I1 flows from the moving contact 11*a* to the moving contact 11*b* to make the direction of a magnetic flux B1 generated between the moving contactor 10 and the fixed contacts 14, 15 downward (see FIG. 6).

Also, when the current I1 flows from the moving contact 11*a* to the moving contact 11*b* in the moving contactor 10, the current flowing through the first terminal portion 12*a* flows into the fixed contact 14. That is to say, in the third axis direction, the direction of the current I1 flowing through the moving contactor 10 is opposite from that of a component of a current flowing through the first fixed extension 120*a*. Thus, the third axis direction component of the current flowing through the first fixed extension 120*a* is larger than the third axis direction component of the current flowing through the second fixed extension 120*b*. This increases the density of downward magnetic flux overall in the magnetic flux B1 generated between the moving contactor 10 and the fixed contacts 14, 15 in the first terminal portion 12*a*.

Also, when the current I1 flows from the moving contact 11*a* to the moving contact 11*b* in the moving contactor 10, the current flowing through the first terminal portion 13*a* flows out of the fixed contact 15. That is to say, in the third axis direction, the direction of the current I1 flowing through the moving contactor 10 is opposite from that of a component of a current flowing through the first fixed extension 130*a*. Thus, the third axis direction component of the current flowing through the first fixed extension 130*a* of the first terminal portion 13*a* is larger than the third axis direction component of the current flowing through the second fixed extension 130*b*. This increases the density of downward magnetic flux overall in the magnetic flux B1 generated between the moving contactor 10 and the fixed contacts 14, 15 in the first terminal portion 13*a*.

Then, the Lorentz force F1 between the moving contact 11*a* and the fixed contact 14 and the Lorentz force F2 between the moving contact 11*b* and the fixed contact 15 both act outward (see FIG. 6). Specifically, the Lorentz force F1 acts from the moving contact 11*a* toward the protrusion 10*a* and the Lorentz force F2 acts from the moving contact 11*b* toward the protrusion 10*b*.

Turning the contact device A1 from ON to OFF while the current I1 is flowing between the fixed terminals 12 and 13 via the moving contactor 10 causes an arc 5 to be generated between the moving contact 11*a* and the fixed contact 14 (see FIG. 6). An arc 6 is also generated between the moving contact 11*b* and the fixed contact 15 (see FIG. 6). Specifically, the arc 5 is generated between the tip portion 110 of the moving contact 11*a* and the tip portion 140 of the fixed contact 14 and the arc 6 is generated between the tip portion 110 of the moving contact 11*b* and the tip portion 150 of the fixed contact 15.

Since the Lorentz forces F1 and F2 are acting outward, the arcs 5 and 6 are pulled outward. This causes the arcs 5 and 6 to move outward (see the arcs 5*a* and 6*a* shown in FIG. 6). Specifically, one end portion of the arc 5 moves to the retracted portion 111 of the moving contact 11*a* and the other end portion of the arc 5 moves to the retracted portion 141 of the fixed contact 14, thus generating the arc 5*a* between the respective retracted portions 111 and 141 of the moving contact 11*a* and fixed contact 14. One end portion of the arc 6 moves to the retracted portion 111 of the moving contact 11*b* and the other end portion of the arc 6 moves to the retracted portion 151 of the fixed contact 15, thus generating the arc 6*a* between the respective retracted portions 111 and 151 of the moving contact 11*b* and fixed contact 15.

The arcs 5*a* and 6*a* are pulled further outward by the Lorentz forces F1 and F2, thus causing the arcs 5*a* and 6*a* to move outward (see the arcs 5*b* and 6*b* shown in FIG. 6).

Specifically, one end portion of the arc 5*a* moves to the protrusion 10*a*, and the other end portion of the arc 5*a* moves to the second fixed extension 120*b* for the fixed contact 14, thus generating the arc 5*b* between the protrusion 10*a* and the second fixed extension 120*b*. One end portion of the arc 6*a* moves to the protrusion 10*b*, and the other end portion of the arc 6*a* moves to the second fixed extension 130*b* for the fixed contact 15, thus generating the arc 6*b* between the protrusion 10*b* and the second fixed extension 130*b*.

In this embodiment, the current I1 flowing from the fixed terminal 12 to the fixed terminal 13 via the moving contactor 10 has a relatively large amount of about 100 A. Thus, when an arc is generated between the moving contact 11*a* and the fixed contact 14 and between the moving contact 11*b* and the fixed contact 15, the load on the moving contacts 11*a*, 11*b* and the fixed contacts 14, 15 becomes heavier. This increases the chances of contact members of the fixed and moving contacts being worn or melted to cause deterioration of the contacts.

Thus, according to this embodiment, the protrusions 10*a*, 10*b* are provided for the moving contactor 10 to facilitate outward movement of the arcs generated with the Lorentz forces F1 and F2. This lightens, even when arcs are generated, the load on the moving contacts 11*a*, 11*b* and the fixed contacts 14, 15. That is to say, this reduces the chances of contact members of the fixed and moving contacts being worn or melted to cause deterioration of the contacts.

Also, according to this embodiment, the ON/OFF states of the contact device A1 are switched with two pairs of moving and fixed contacts, namely, the pair of the moving contact 11*a* and the fixed contact 14 and the pair of the moving contact 11*b* and the fixed contact 15. The ON/OFF states of the contact device A1 could be switched with only one pair of contacts, namely, a pair of a moving contact and a fixed contact. When the ON/OFF states are switched with only one pair of contacts, the moving contactor with the moving contact needs to have a spring property. In addition, to ensure a certain current capacity, a plurality of plates needs to be stacked one on top of another. Meanwhile, according to this embodiment, the ON/OFF states are switched with the two pairs of contacts, and therefore, the moving contactor 10 does not have to have a spring property unlike the situation where the ON/OFF states are switched with only one pair of contacts. In addition, there is no need to stack a plurality of plates one on top of another to ensure a certain current capacity. That is to say, this simplifies the configuration of the moving contactor 10 compared to the situation where the ON/OFF states are switched with only one pair of contacts. Furthermore, in the electromagnetic relay 1 according to this embodiment, the moving contactor 10 does not have to have a spring property, and therefore, there is no need to take possible deterioration of the spring property of the moving contactor 10 due generation of heat involved with the supply of a large amount of current into consideration.

In addition, a contact gap needs to be secured to make the contact device A1 compliant with the IEC standard, for example. Suppose the gap distance (contact gap) to be secured between the moving and fixed contacts to allow a large amount of current to flow in a situation where the ON/OFF states are switched with one pair of contacts is X1. When the ON/OFF states are switched with two pairs of contacts, the sum of a gap distance X2 between the moving contact 11*a* and the fixed contact 14 and a gap distance X3 between the moving contact 11*b* and the fixed contact 15 may be equal to X1 (i.e., X1=X2+X3) to allow a large amount of current to flow. That is to say, switching the ON/OFF states with two pairs of contacts makes it easier to secure a sufficient contact gap than switching the ON/OFF states with one pair of contacts.

In this embodiment, the fixed terminal 12 has the cutout portion 12*e* and the fixed terminal 13 has the cutout portion 13*e*. This allows the current I1 to be input to, or output from, the fixed contact 14 and the current I1 to be output from, or input to, the fixed contact 15 to have a current component, of which the direction is opposite from that of the current I1 flowing through the moving contactor 10. Specifically, the current I1 flowing through the first terminal portion 12*a* of the fixed terminal 12 provided with the fixed contact 14 and the current I1 flowing through the first terminal portion 13*a* of the fixed terminal 13 provided with the fixed contact 15 have a current component, of which the direction is opposite from that of the current I1 flowing through the moving contactor 10.

Now, it will be described with reference to FIGS. 4A and 4B how the current I1 flows from the fixed terminal 12 to the fixed terminal 13 through the moving contactor 10.

First, the current flowing through the fixed terminal 12 will be described with reference to FIG. 4A. Currents I1 are input from an external device to a first piece 12*f* and a second piece 12*g* of the third terminal portion 12*c* of the fixed terminal 12. Thereafter, the currents I1 input to the first piece 12*f* and the second piece 12*g* flow upward through the third terminal portion 12*c* to be confluent with each other at the second terminal portion 12*b*. The current I1 flowing from the second terminal portion 12*b* toward the first terminal portion 12*a* is directed toward the opening 12*d* (i.e., toward the moving contact 11*a*). At this time, the current I1 flowing through the first terminal portion 12*a* includes a component of a current flowing outward parallel to the third axis (i.e., in the direction in which the fixed terminals 12 and 13 are arranged side by side) and eventually input to the fixed contact 14.

Next, the current flowing through the fixed terminal 13 will be described with reference to FIG. 4B. Since the fixed terminal 13 has the cutout portion 13*e*, the current I1 output from the fixed contact 15 flows inward parallel to the third axis (i.e., in the direction in which the fixed terminals 12 and 13 are arranged side by side) and then flows into the second terminal portion 13*b*. The current I1 that has flowed through the second terminal portion 13*b* flows into the third terminal portion 13*c* and then splits into two currents to flow downward through a first piece 13*f* and a second piece 13*g*. Thereafter, the currents I1 are output to an external device. As can be seen, the current I1 flowing through the first terminal portion 13*a* of the fixed terminal 13 has a component of a current flowing inward parallel to the third axis (i.e., in the direction in which the fixed terminals 12 and 13 are arranged side by side) after having been output from the fixed contact 15.

As can be seen, providing the cutout portion 12*e* for the fixed terminal 12 causes the current I1 to be input to, or output from, the fixed contact 14 in the first terminal portion 12*a* facing the moving contactor 10 to have a current component, of which the direction is opposite from that of the current I1 flowing through the moving contactor 10. In addition, providing the cutout portion 13*e* for the fixed terminal 13 causes the current I1 to be input to, or output from, the fixed contact 15 in the first terminal portion 13*a* facing the moving contactor 10 to have a current component, of which the direction is opposite from that of the current I1 flowing through the moving contactor 10.

The current I1 flowing through the first terminal portion 12*a* of the fixed terminal 12 has a current component, of which the direction is opposite from that of the current I1 flowing through the moving contactor 10. Thus, the magnetic flux generated between the moving contactor 10 and the fixed terminal 12 by that current component in the first terminal portion 12*a* of the fixed terminal 12 may have the same direction as the magnetic flux B1 described above. Likewise, the current I1 flowing through the first terminal portion 13*a* of the fixed terminal 13 has a current component, of which the direction is opposite from that of the current I1 flowing through the moving contactor 10. Thus, the magnetic flux generated between the moving contactor 10 and the fixed terminal 13 by that current component in the first terminal portion 13*a* of the fixed terminal 13 may have the same direction as the magnetic flux B1 described above.

This further increases the strengths of the Lorentz force F1 produced between the moving contact 11*a* and the fixed contact 14 and the Lorentz force F2 produced between the moving contact 11*b* and the fixed contact 15.

Also, the current I1 input from an external device to the fixed terminal 12 flows through the third terminal portion 12*c* and the second terminal portion 12*b* in this order and then flows toward the moving contact 11*a* via the first fixed extension 120*a* of the first terminal portion 12*a* (see FIG. 4A). That is to say, the amount of current I1 flowing through the second fixed extension 120*b* is smaller than the amount of current I1 flowing through the first fixed extension 120*a*. In other words, the component of the current flowing through the first fixed extension 120*a* is larger than the component of the current flowing through the second fixed extension 120*b*. Thus, a path including the first fixed extension 120*a* is present as a path that allows a larger amount of current to flow than the path of the current flowing through the second fixed extension 120*b*. Consequently, as described above, the current I1 flowing through the first terminal portion 12*a* flows outward parallel to the third axis (in the direction in which the fixed terminals 12 and 13 are arranged side by side) and eventually flows into the fixed contact 14.

Meanwhile, the current I1 input from the moving contactor 10 to the fixed terminal 13 flows through the first fixed extension 130*a*, the second terminal portion 13*b*, and the third terminal portion 13*c* in this order (see FIG. 4B). Since the cutout portion 13*e* is provided in this embodiment, the current component of the current I1 flowing through the second terminal portion 13*b* via the second fixed extension 130*b* is smaller than the current component flowing through the first fixed extension 130*a*. Thus, a path including the first fixed extension 130*a* is present as a path that allows a larger amount of current to flow than the path of the current flowing through the second fixed extension 130*b*. Consequently, as described above, the current Ii flowing through the first terminal portion 13*a* flows inward parallel to the third axis (in the direction in which the fixed terminals 12 and 13 are arranged side by side) and eventually flows out of the fixed contact 15.

Note that not both of the fixed terminals 12 and 13 have to have their own cutout portion 12*e*, 13*e*.

If the fixed terminal 12 has no cutout portions 12*e*, then the current I1 to be input to the fixed contact 14 flows upward from the bottom. In that case, the magnetic flux generated between the moving contactor 10 and the fixed terminal 12 in the first terminal portion 12*a* of the fixed terminal 12 does not have the same direction as the magnetic flux B1 described above and yet the arc is still movable outward. In that case, an end portion of the arc moves obliquely toward an upper outer corner as being affected by the direction of the magnetic flux generated between the moving contactor 10 and the fixed terminal 12 in the first terminal portion 12*a* of the fixed terminal 12. Thus, if the fixed terminal 12 includes no cutout portions 12*e*, the protrusion 10*a* is suitably provided at an upper outer corner of the moving extension 100.

If the fixed terminal 13 has no cutout portions 13*e*, then the current I1 output from the fixed contact 15 flows downward from the top. In that case, the magnetic flux generated between the moving contactor 10 and the fixed terminal 13 in the first terminal portion 13*a* of the fixed terminal 13 does not have the same direction as the magnetic flux B1 described above and yet the arc is still movable outward. In that case, an end portion of the arc moves obliquely toward an upper outer corner as being affected by the direction of the magnetic flux generated between the moving contactor 10 and the fixed terminal 13 in the first terminal portion 13*a* of the fixed terminal 13. Thus, if the fixed terminal 13 includes no cutout portions 13*e*, the protrusion 10*b* is suitably provided at an upper outer corner of the moving extension 101.

<Description of Implementation of Electromagnetic Relay 1>

Next, it will be described how to implement the electromagnetic relay 1.

The electromagnetic relay 1 is mounted on a board 200 to form an electrical device 500. In other words, the electrical device 500 includes the electromagnetic relay 1 and the board 200. The board 200 has a first opening 201 and a second opening 202, of which the longer sides extend in the third axis direction, and a third opening 203 and a fourth opening 204, of which the longer sides extend in the rightward/leftward direction (see FIG. 7).

The third terminal portion 12*c* of the fixed terminal 12 is inserted into the first opening 201. The third terminal portion 13*c* of the fixed terminal 13 is inserted into the second opening 202. The coil terminal 21 is inserted into the third opening 203. The coil terminal 22 is inserted into the fourth opening 204.

Next, the shape of the respective third terminal portions 12*c* and 13*c* of the fixed terminals 12 and 13 will be described.

Since the third terminal portion 12*c* of the fixed terminal 12 has a cutout portion 12*h*, the third terminal portion 12*c* is divided in the third axis direction into the first piece 12*f* and the second piece 12*g* (see FIG. 4A). In this embodiment, the respective dimensions W1 and W2 as measured in the third axis direction of the first piece 12*f* and the second piece 12*g* are equal to each other and greater than the dimension W3 as measured in the third axis direction of the cutout portion 12*h* (see FIG. 8A). Setting the respective dimensions W1 and W2 as measured in the third axis direction of the first and second pieces 12*f* and 12*g* at a relatively large value allows a larger amount of current to flow through the contact device A1. The combination of the first piece 12*f* and the second piece 12*g* corresponds to the divided portion according to the present disclosure.

Since the third terminal portion 13*c* of the fixed terminal 13 has a cutout portion 13*h*, the third terminal portion 13*c* is divided in the third axis direction into the first piece 13*f* and the second piece 13*g* (see FIG. 4B). In this embodiment, the respective dimensions as measured in the third axis direction of the first piece 13*f* and the second piece 13*g* are equal to each other and greater than the dimension as measured in the third axis direction of the cutout portion 13*h* (see FIG. 8A). Setting the respective dimensions as measured in the third axis direction of the first and second pieces 13*f* and 13*g* at a relatively large value allows a larger amount of current to flow through the contact device A1. The combination of the first piece 13*f* and the second piece 13*g* corresponds to the divided portion according to the present disclosure.

In this embodiment, the first and second pieces 12*f* and 12*g* of the fixed terminal 12 and the first and second pieces 13*f* and 13*g* of the fixed terminal 13 all have the same dimension.

The first piece 12*f* of the fixed terminal 12 has tapered portions 121 and 122 at both ends in the third axis direction. The second piece 12*g* of the fixed terminal 12 has tapered portions 123 and 124 at both ends in the third axis direction.

The first piece 13*f* of the fixed terminal 13 has tapered portions 131 and 132 at both ends in the third axis direction. The second piece 13*g* of the fixed terminal 13 has tapered portions 133 and 134 at both ends in the third axis direction.

Figure 1A:
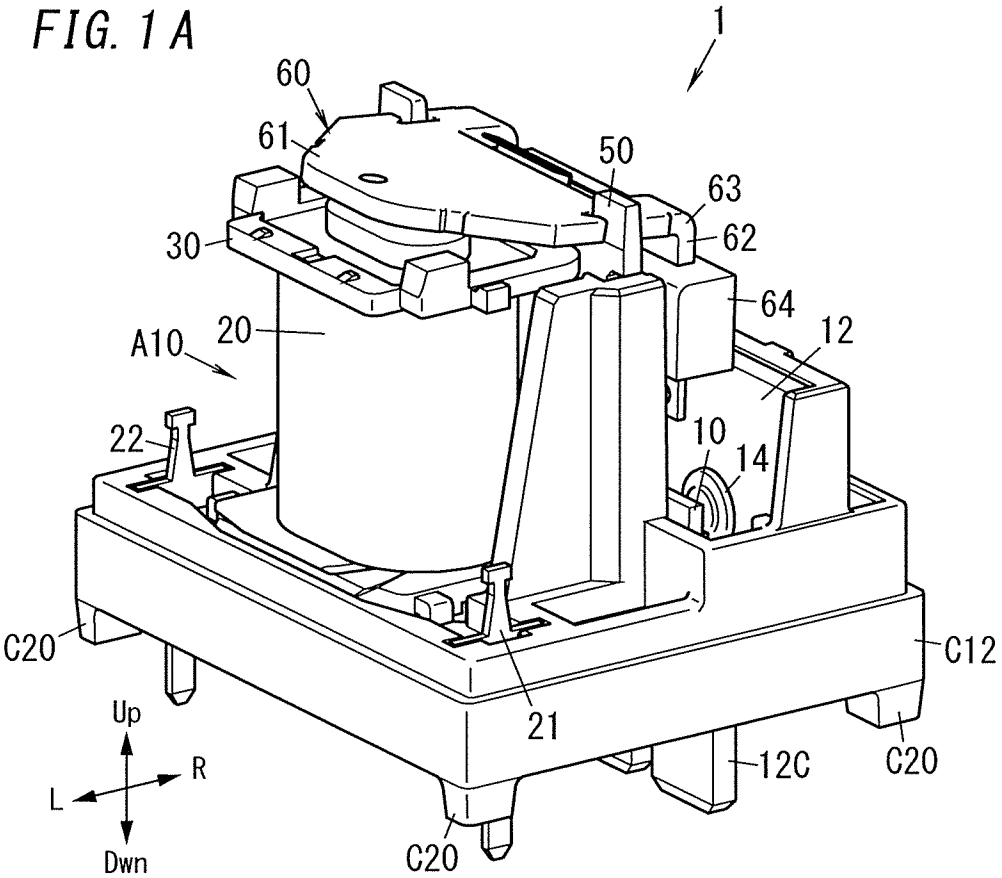
FIG. 1A is a perspective view illustrating a part of an electromagnetic relay according to an exemplary embodiment of the present invention.
Figure 7:
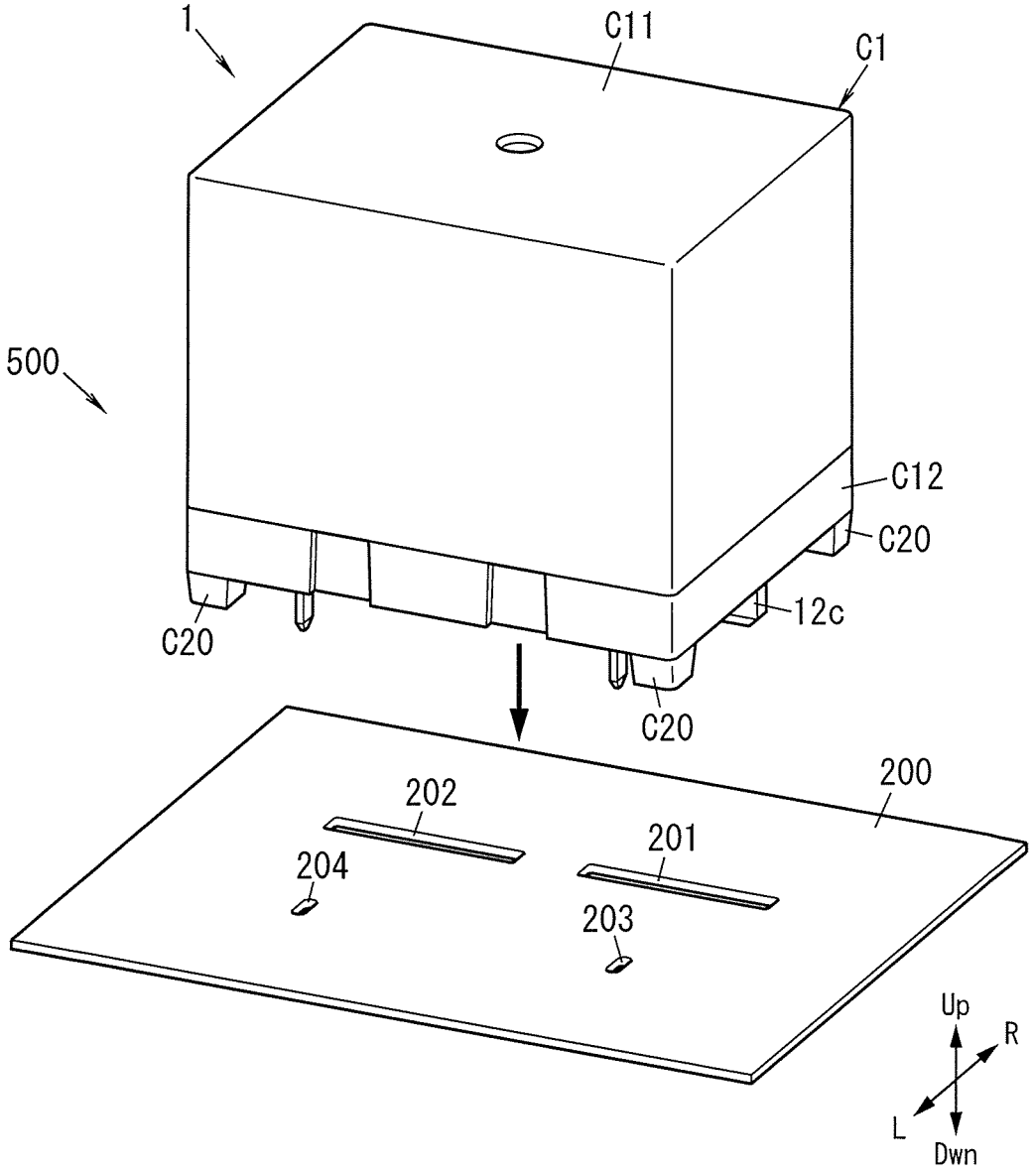
FIG. 7 illustrates how to mount an electromagnetic relay.

The base C12 has, at the bottom, four legs C20 protruding downward (see FIGS. 1A and 7).

Figure 8A:
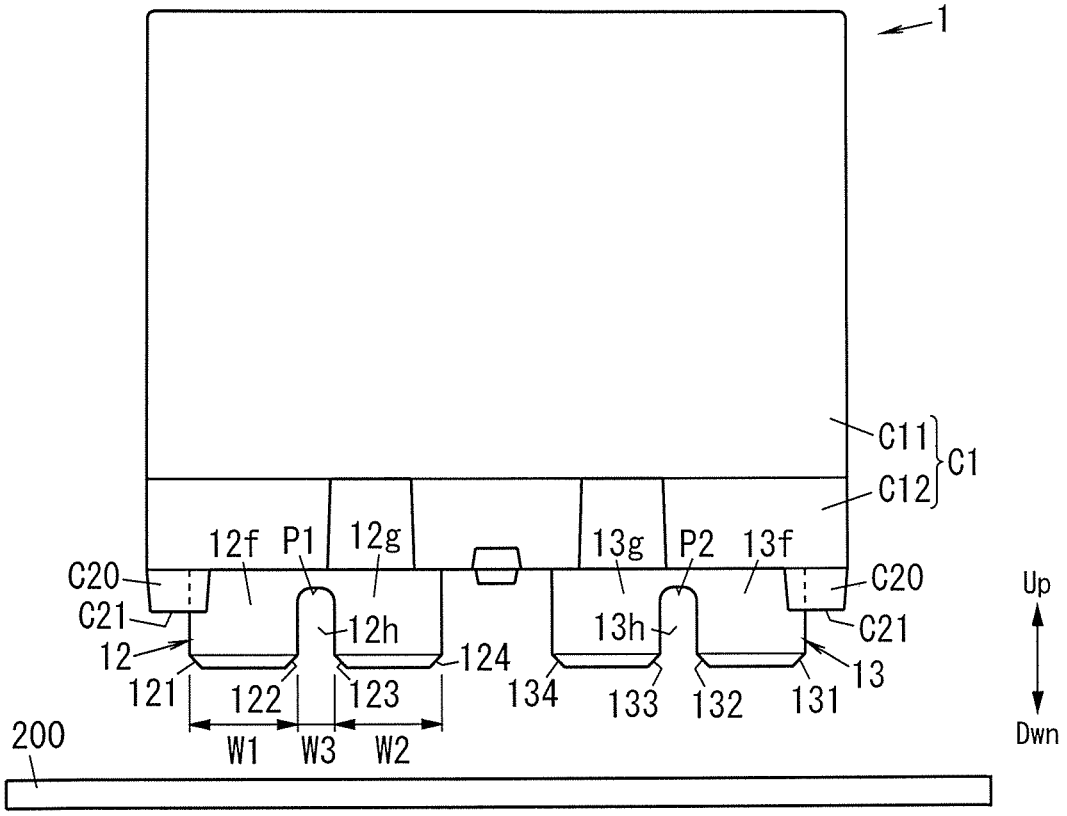
FIG. 8A is a front view of an electromagnetic relay yet to be mounted on a board.
Figure 8B:
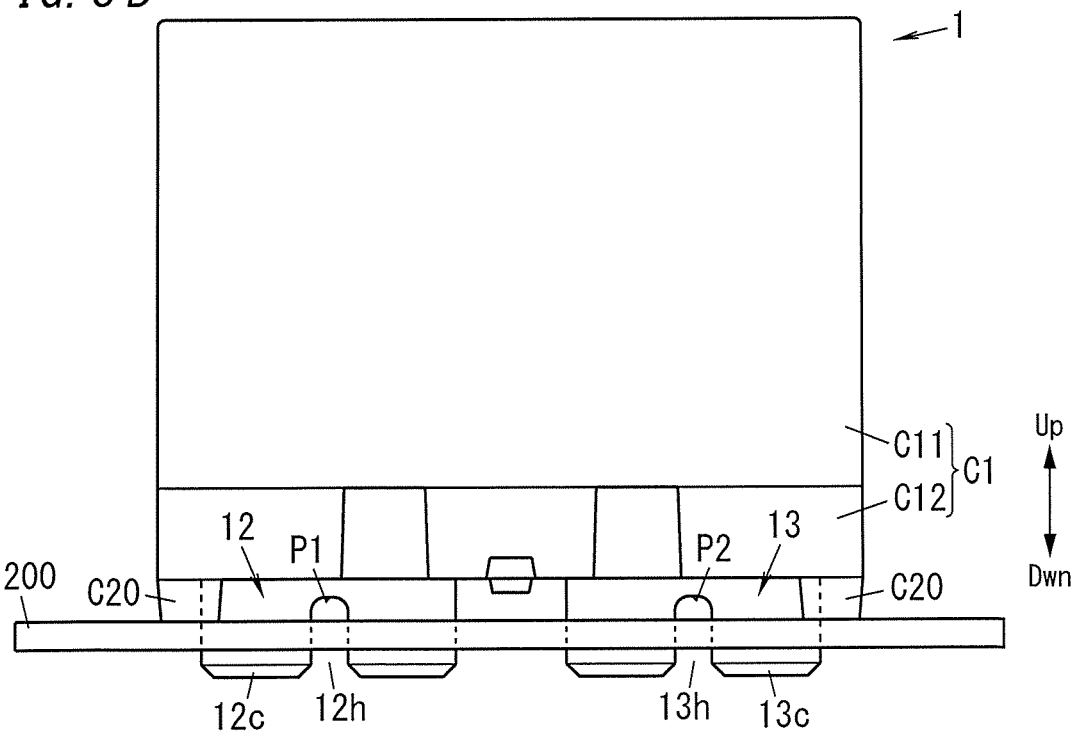
FIG. 8B is a front view of the electromagnetic relay that has been mounted on the board.

The respective bottom ends C21 of the legs C20 are located below respective end portions P1 and P2 of the cutout portions 12*h* and 13*h* (see FIG. 8A). Thus, when the electromagnetic relay 1 is mounted on the board 200, the respective end portions P1 and P2 of the cutout portions 12*h* and 13*h* are located closer to the case C1 in the upward/downward direction than the board 200 is (see FIG. 8B).

In this state, the electromagnetic relay 1 and the board 200 are fixed together by soldering, e.g., by being subjected to flow soldering in which a molten solder flow is sprayed onto the gap between them. When the fixed terminal 12 is soldered onto the board 200, the molten solder creeps up along the cutout portion 12*h* of the fixed terminal 12 to fill the cutout portion 12*h* with the solder 300 (see FIG. 9). Likewise, when the fixed terminal 13 is soldered onto the board 200, the molten solder creeps up along the cutout portion 13*h* of the fixed terminal 13 to fill the cutout portion 13*h* with the solder 310 (see FIG. 9). That is to say, the presence of the cutout portions 12*h* and 13*h* not only increases the wettability so much as to finish soldering in a short time, but also increases the strength of soldering while lessening the harmful effect of the heat of the molten solder on a part with relatively low thermal resistance even when that part needs to be soldered along with the electromagnetic relay 1.

Figure 9:
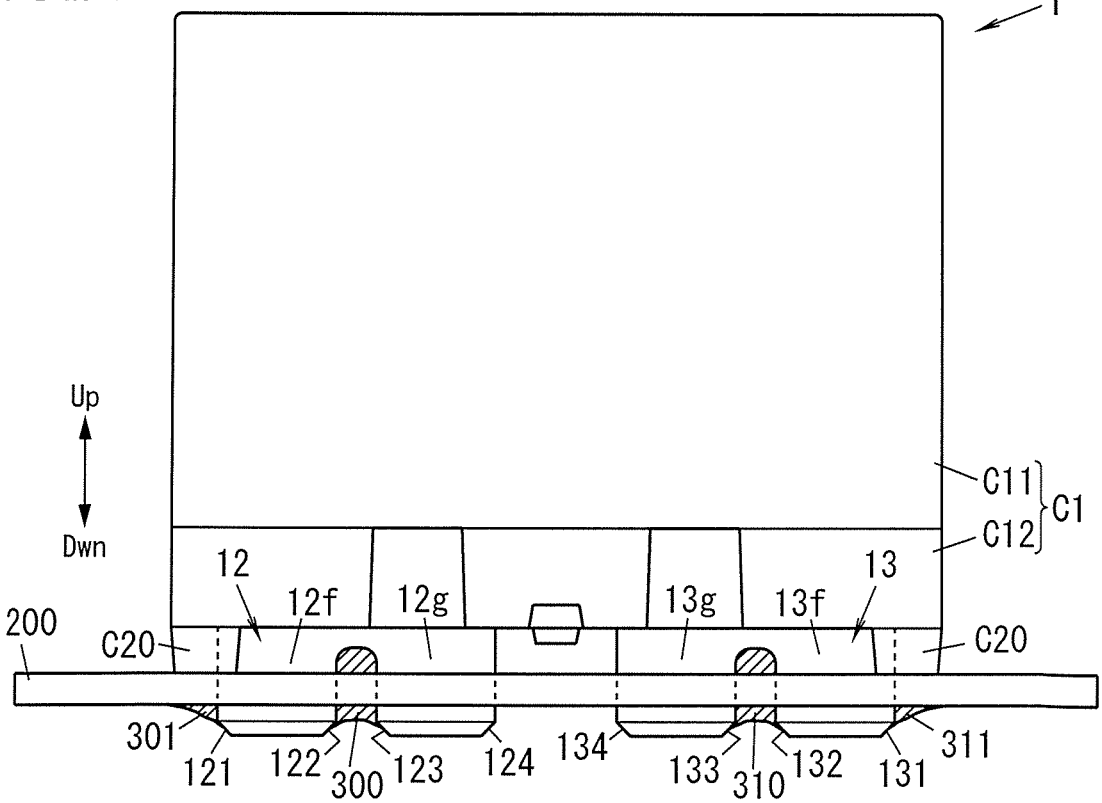
FIG. 9 is a front view of the electromagnetic relay soldered to the board.

In addition, the first and second pieces 12*f* and 12*g* of the fixed terminal 12 have the tapered portions 122 and 123, respectively, thus preventing the solder that has crept up along the cutout portion 12*h* from expanding downward from the respective tips of the first and second pieces 12*f* and 12*g* (see FIG. 9). Likewise, the first and second pieces 13*f* and 13*g* of the fixed terminal 13 have the tapered portions 132 and 133, respectively, thus preventing the solder that has crept up along the cutout portion 13*h* from expanding downward from the respective tips of the first and second pieces 13*f* and 13*g* (see FIG. 9).

In the embodiment described above, the third terminal portions 12*c*, 13*c* each have a shape with two pieces (i.e., the first piece and the second piece). However, this shape is only an example and should not be construed as limiting. Alternatively, the third terminal portions 12*c*, 13*c* may each be divided into three or more pieces. In that case, the dimension as measured in the third axis direction of each of those three or more pieces is also greater than the dimension as measured in the third axis direction of an associated cutout portion.

<First Variation>

In the embodiment described above, providing the cutout portions 12*e* and 13*e* for the fixed terminals 12 and 13 causes the current I1 input to one of the two fixed contacts 14 and 15 and the current I1 output from the other fixed contact to have a current component, of which the direction is opposite from that of the current I1 flowing through the moving contactor 10. However, the fixed terminals 12 and 13 do not have to have such a configuration to cause the current I1 flowing through the fixed terminals 12 and 13 to have such a current component, of which the direction is opposite from the current I1 flowing through the moving contactor 10. Rather, one of the two fixed terminals 12 and 13 has only to be formed such that the current I1 input to that fixed terminal 12 from an external device flows in the opposite direction from the current I1 flowing through the moving contactor 10.

Figure 10A:
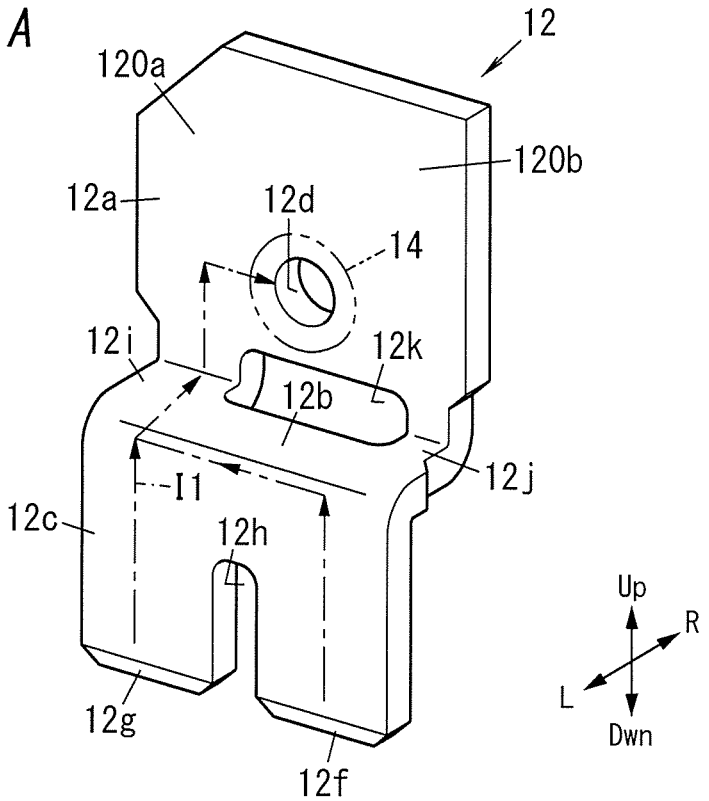
FIGS. 10A and 10B illustrate the shapes of fixed terminals according to a first variation.

For example, the fixed terminal 12 may have an opening 12*k* at the junction between the first terminal portion 12*a* and the second terminal portion 12*b* as shown in FIG. 10A. In that case, a first coupling portion 12*i* is provided at one end in the third axis direction of the opening 12*k* and a second coupling portion 12*j* is provided at the other end in the third axis direction of the opening 12*k*. The first coupling portion 12*i* is coupled to the first fixed extension 120*a*. The second coupling portion 12*j* is coupled to the second fixed extension 120*b*. The first coupling portion 12*i* has a larger dimension in the third axis direction than the second coupling portion 12*j*. Thus, the current component of the current flowing through the first coupling portion 12*i* is larger than that of the current flowing through the second coupling portion 12*j*. Consequently, the component of the current flowing through the first fixed extension 120*a* is greater than the component of the current flowing through the second fixed extension 120*b*.

Figure 10B:
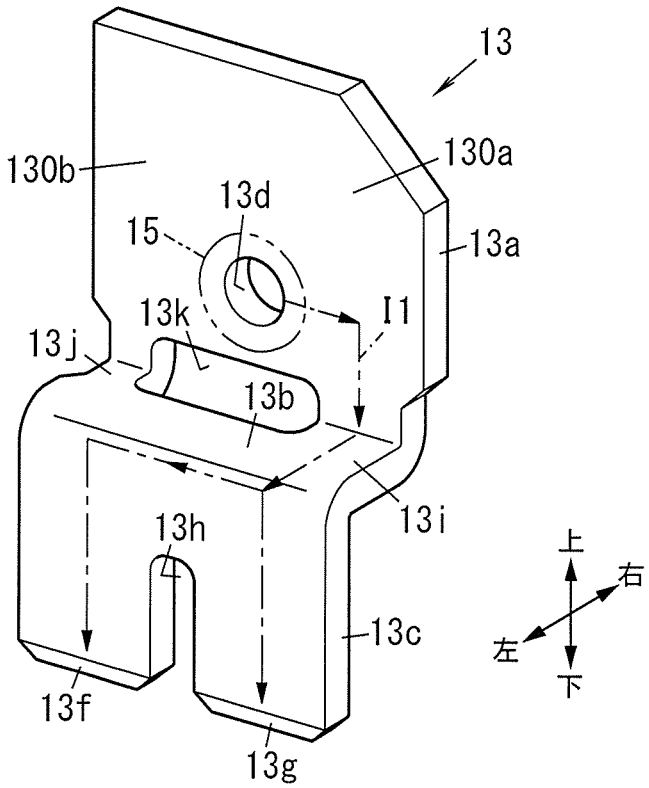

Likewise, the fixed terminal 13 may have an opening 13*k* at the junction between the first terminal portion 13*a* and the second terminal portion 13*b* as shown in FIG. 10B. In that case, a first coupling portion 13*i* is provided at one end in the third axis direction of the opening 13*k* and a second coupling portion 13*j* is provided at the other end in the third axis direction of the opening 13*k*. The first coupling portion 13*i* is coupled to the first fixed extension 130*a*. The second coupling portion 13*j* is coupled to the second fixed extension 130*b*. The first coupling portion 13*i* has a larger dimension in the third axis direction than the second coupling portion 13*j*. Thus, the current component of the current flowing through the first coupling portion 13*i* is larger than that of the current flowing through the second coupling portion 13*j*. Consequently, the component of the current flowing through the first fixed extension 130*a* is greater than the component of the current flowing through the second fixed extension 130*b*.

Therefore, the current I1 input from an external device to that one fixed terminal has a current component, of which the direction is opposite from the current I1 flowing through the moving contactor 10. The other fixed terminal has only to be formed such that the current I1 output from the other fixed terminal to an external device flows in the opposite direction from the current I1 flowing through the moving contactor 10. This allows the current I1 output from the other fixed terminal to the external device to have a current component, of which the direction is opposite from the current I1 flowing through the moving contactor 10.

<Second Variation>

In the embodiment described above, the moving contactor 10 includes the protrusions 10*a* and 10*b* with a prismatic shape. However, this is only an example and should not be construed as limiting.

Figure 11:
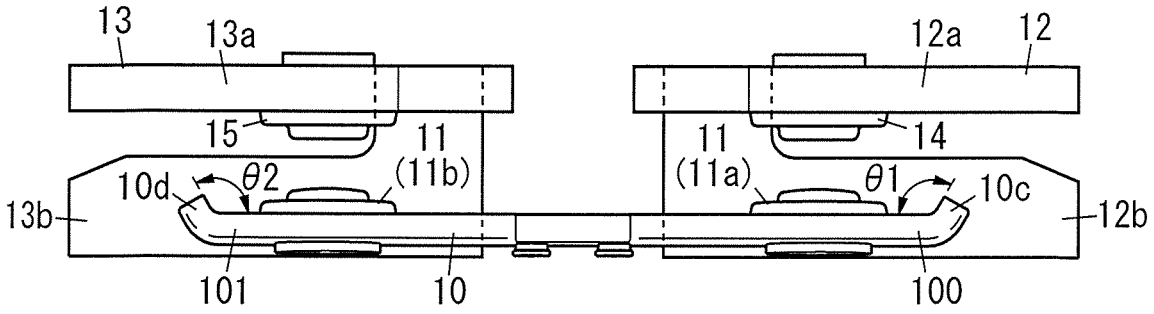
FIG. 11 illustrates the shape of a moving contactor according to a second variation.

Alternatively, the moving contactor 10 may also have a protrusion 10*c*, which is formed by bending an end portion in the third axis direction of the moving extension 100 toward the fixed terminal 12 (see FIG. 11). For example, the protrusion 10*c* may be provided for the entire width (corresponding to the upward/downward direction) of the moving extension 100. Also, the angle θ1 formed between the protrusion 10*c* and the moving contactor 10 is suitably an obtuse angle. Setting the angle θ1 at an obtuse angle allows the arc generated between the fixed contact 14 and the moving contact 11*a* to move outward more easily. The tip of the protrusion 10*c* faces the first terminal portion 12*a* in the second axis direction.

Likewise, the moving contactor 10 may also have a protrusion 10*d*, which is formed by bending an end portion in the third axis direction of the moving extension 101 toward the fixed terminal 13 (see FIG. 11). For example, the protrusion 10*d* may be provided for the entire width (corresponding to the upward/downward direction) of the moving extension 100. Also, the angle θ2 formed between the protrusion 10*d* and the moving contactor 10 is suitably an obtuse angle. Setting the angle θ2 at an obtuse angle allows the arc generated between the fixed contact 15 and the moving contact 11*b* to move outward more easily. The tip of the protrusion 10*d* faces the second terminal portion 12*b* in the second axis direction.

In this variation, the protrusion 10*c* is provided for the entire width (corresponding to the upward/downward direction) of the moving extension 100. However, this is only an example and should not be construed as limiting. Alternatively, the protrusion 10*c* may also be provided for only a part of the width (corresponding to the upward/downward direction) of the moving extension 100. In that case, the protrusion 10*c* may be provided for an upper, lower, or middle part of the width (corresponding to the upward/downward direction) of the moving extension 100. Likewise, the protrusion 10*d* may also be provided for an upper, lower, or middle part of the width (corresponding to the upward/downward direction) of the moving extension 100.

<Other Variations>

Other variations will be enumerated one after another. Note that any of the variations to be described below may be adopted as appropriate in combination with the exemplary embodiment described above.

In the exemplary embodiment described above, the moving contacts 11*a*, 11*b* and the fixed contacts 14, 15 are each formed in a circular shape when viewed in the rightward/leftward direction and each have a shape with two steps, of which the diameter decreases toward the other contact facing itself. However, the moving contacts 11*a*, 11*b* and the fixed contacts 14, 15 do not have to have such a shape. Alternatively, the moving contacts 11*a*, 11*b* and the fixed contacts 14, 15 may also have a shape with three or more steps.

Also, in the exemplary embodiment described above, both types of contacts, namely, the moving contacts 11*a*, 11*b* and the fixed contacts 14, 15, are formed to have a shape with multiple steps. However, this is only an example and should not be construed as limiting. Rather, at least one type of contacts, namely, either the moving contacts 11*a*, 11*b* or the fixed contacts 14, 15, or both, may be formed to have such a multi-step shape.

For example, if the fixed contacts 14, 15 are formed to have a multi-step shape and the moving contacts 11*a*, 11*b* are formed to have a non-multi-step shape, the moving contacts 11*a*, 11*b* may have a reduced thickness. As used herein, the thickness of the moving contacts 11*a*, 11*b* refers to their dimension as measured in the rightward/leftward direction. The moving contactor 10 and the moving contacts 11*a*, 11*b* all move in an arc pattern as described above. Thus, reducing the thickness of the moving contacts 11*a*, 11*b* allows the rolling force of the arc movement to be decreased.

In the exemplary embodiment described above, the protrusions 10*a*, 10*b* have a prismatic shape. However, this is only an example and should not be construed as limiting. Alternatively, the protrusions 10*a*, 10*b* may have a polygonal prismatic shape or a columnar shape as well. Still alternatively, the protrusions 10*a*, 10*b* may also have a polygonal pyramidal shape or a conical shape as well. That is to say, the protrusions 10*a*, 10*b* may have any shape as long as the protrusions 10*a*, 10*b* protrude from the surface, facing the fixed terminals 12, 13, of the moving contactor 10. Nevertheless, the height of the protrusions 10*a*, 10*b* needs to be less than the dimension as measured in the rightward/leftward direction of the moving contacts 11*a*, 11*b* protruding from the moving contactor 10 toward the fixed member 16.

In the exemplary embodiment described above, the moving contactor 10 includes the protrusions 10*a*, 10*b* at both ends thereof in the third axis direction. However, this is only an example and should not be construed as limiting. Rather, the moving contactor 10 may include the protrusion on at least one end thereof in the third axis direction.

Furthermore, in the embodiment described above, the protrusions 10*a*, 10*b* are provided for the moving contactor 10. However, this is only an example and should not be construed as limiting. The protrusions 10*a*, 10*b* may be provided for at least one of the moving contactor 10 or the fixed member 16. For example, if the protrusions 10*a*, 10*b* are provided for the fixed member 16, the protrusion 10*a* is provided for the second fixed extension 120*b* of the fixed terminal 12 and the protrusion 10*b* is provided for the second fixed extension 130*b* of the fixed terminal 13. Also, instead of, or in addition to, providing the protrusions 10*c*, 10*d* for the moving contactor 10, each of the fixed terminals 12, 13 may be provided with a protrusion by bending an end portion thereof in the third axis direction toward the moving contactor 10.

Furthermore, in the exemplary embodiment described above, the protrusions 10*a*, 10*b* and the moving contactor 10 form respective parts of the same member. However, this is only an example and should not be construed as limiting. Alternatively, the protrusions 10*a*, 10*b* and the moving contactor 10 may belong to two different members. In that case, the moving contactor 10 will have a different current conductivity from the protrusions 10*a*, 10*b*, and therefore, the arc will move less smoothly than in a situation where the moving contactor 10 and the protrusions 10*a*, 10*b* form respective parts of the same member. Still, the advantage of lightening the load on the contacts is achieved in that case. Stated otherwise, making the protrusions 10*a*, 10*b* and the moving contactor 10 form respective parts of the same member allows the arc generated to move smoothly.

In the exemplary embodiment described above, a single stable relay has been described as an exemplary electromagnetic relay 1 to which the contact device A1 is applied. However, this is only an example and should not be construed as limiting. Alternatively, the contact device A1 is also applicable to a single coil latching relay or a double coil latching relay, whichever is appropriate.

<Resume of Embodiments>

(1) An electromagnetic relay 1 includes a moving contactor 10, a pair of moving contacts 11, a fixed member 16, a pair of fixed contacts 14, 15, and a drive mechanism (electromagnetic device A10). The pair of moving contacts 11 are provided for the moving contactor 10 and are arranged side by side in one direction (in a third axis direction). The fixed member 16 includes a pair of fixed terminals 12, 13 arranged side by side in the one direction to face the moving contactor 10. The fixed contacts 14, 15 are provided for the pair of fixed terminals 12, 13, respectively. The drive mechanism displaces the moving contactor 10 such that the pair of moving contacts 11 moves back and forth between a closed position where the pair of moving contacts 11 are in contact with the pair of fixed contacts 14, 15, respectively, and an open position where the pair of moving contacts 11 are out of contact with the pair of fixed contacts 14, 15, respectively. The moving contactor 10 includes a pair of moving extensions 100, 101 protruding in the one direction on both sides of the pair of moving contacts 11. The fixed member 16 includes a pair of fixed extensions (second fixed extensions 120*b*, 130*b*) protruding in the one direction on both sides of the pair of fixed contacts 14, 15. At least one pair of extensions, selected from the group consisting of the pair of moving extensions 100, 101 and the pair of fixed extensions (second fixed extensions 120*b*, 130*b*), has protrusions (e.g., a protrusion 10*a*) protruding toward the other pair of extensions.

Recently, an electromagnetic relay with large capacity has been provided. Such a large-capacity electromagnetic relay comes to have a large contact current. Therefore, when an arc is generated between the fixed contact and moving contact thereof, the contact members of the fixed contact and moving contact are either worn or melted to deteriorate the contacts, thus possibly causing some instability in the operation of the electromagnetic relay.

Thus, according to the configuration of (1), considering the relationship between the magnetic flux generated between the moving contactor 10 and the fixed member 16 by the current flowing between the pair of moving contacts 11 and the current flowing between the moving contact 11 (such as the moving contact 11*a*) and the fixed contact (such as the fixed contact 14) that the moving contact 11 faces, the Lorentz force acts outward. This causes one end portion of the arc generated between the contacts to move toward the protrusions. Causing the arc generated to move in this manner reduces the deterioration of the fixed and moving contacts.

(2) In an embodiment of the electromagnetic relay 1, which may be implemented in combination with (1), the protrusions 10*a*, 10*b* are provided for the pair of moving extensions 100, 101, respectively.

According to this configuration, providing the protrusions 10*a*, 10*b* at both ends of the moving contactor 10, i.e., for the moving extensions 100, 101, respectively, accelerates the movement of an arc generated between the two pairs of contacts, thus causing the arc to move to the protrusions 10*a*, 10*b*.

(3) In another embodiment of the electromagnetic relay 1, which may be implemented in combination with (2), the protrusions 10*a*, 10*b* and the moving contactor 10 form respective parts of the same member.

According to this configuration, making the protrusions 10*a*, 10*b* and the moving contactor 10 form respective parts of the same member allows an arc generated to move smoothly.

(4) In still another embodiment of the electromagnetic relay 1, which may be implemented in combination with any one of (1) to (3), at least one pair of contacts, selected from the group consisting of the pair of moving contacts 11 and the pair of fixed contacts 14, 15, has a multi-step shape, of which a diameter decreases toward the other pair of contacts that faces the at least one pair of contacts.

This configuration allows the arc generated to move stepwise from the tip of the contacts toward the protrusions.

(5) In yet another embodiment of the electromagnetic relay 1, which may be implemented in combination with any one of (1) to (4), a current I1, flowing through portions (first terminal portions 12*a*, 13*a*), facing the moving contactor 10 with respect to the movement direction of the moving contactor 10, of the pair of fixed terminals 12, 13 has a current component, of which the direction is opposite from that of a current I1 flowing between the pair of moving contacts 11.

This configuration further increases the strength of a magnetic flux generated between the moving contactor 10 and the fixed terminals 12, 13, thus further increasing the outwardly acting Lorentz force. This accelerates the movement of the arc generated between the contacts to cause the arc to move to the protrusions 10*a*, 10*b*.

(6) In yet another embodiment of the electromagnetic relay 1, which may be implemented in combination with any one of (1) to (5), the moving contactor 10 is displaced by turning around the one direction as an axis of rotation to move the pair of moving contacts 11 back and forth between the closed position and the open position.

This configuration lightens, even when an arc is generated in a hinged electromagnetic relay, the load on the fixed and moving contacts.

(7) In yet another embodiment of the electromagnetic relay 1, which may be implemented in combination with any one of (1) to (6), the protrusions are provided, in a direction (upward/downward direction) perpendicular to both the one direction and the direction in which the moving contactor 10 and the pair of fixed terminals 12, 13 are arranged side by side, for a part of the at least one pair of extensions.

This configuration accelerates the movement of one end portion of the arc generated toward the protrusions.

(Resume)

As can be seen from the foregoing description, a contact device (A1) according to a first aspect includes: a moving contactor (10); a pair of moving contacts (11) arranged side by side in one direction; a pair of fixed terminals (12, 13) arranged side by side in the one direction; and a pair of fixed contacts (14, 15). The pair of moving contacts (11) are provided for the moving contactor (10). The pair of fixed terminals (12, 13) face the moving contactor (10). The pair of fixed contacts (14, 15) are provided for the pair of fixed terminals (12, 13), respectively. The moving contactor (10) is configured to move back and forth between a closed position where the pair of moving contacts (11) are in contact with the pair of fixed contacts (14, 15), respectively, and an open position where the pair of moving contacts (11) are out of contact with the pair of fixed contacts (14, 15), respectively. At least one fixed terminal, selected from the pair of fixed terminals (12, 13), includes a contact holder (first terminal portion 12*a*, 13*a*) facing the moving contactor (10) in a direction in which the closed position and the open position are connected together. The contact holder includes: a first fixed extension (120*a*, 130*a*) protruding, in the one direction, from the fixed contact of the one fixed terminal toward the other fixed terminal; and a second fixed extension (120*b*, 130*b*) protruding from the fixed contact away from the other fixed terminal. As for either a current component flowing in the one direction into the fixed contact or a current component flowing in the one direction out of the fixed contact, the current component flowing through the first fixed extension has a larger amount of current than a current component flowing through the second fixed extension.

This configuration accelerates the movement of an arc generated between the contacts, thus reducing the deterioration of the fixed and moving contacts.

In a contact device (A1) according to a second aspect, which may be implemented in conjunction with the first aspect, the fixed terminal with the contact holder, out of the pair of fixed terminals (12, 13), includes an extended portion (third terminal portion 12*c*, 13*c*) which is arranged in a direction intersecting with the one direction with respect to the contact holder and which is connected to a member to be connected to an external device. The extended portion is coupled to the contact holder asymmetrically with respect to an axis that is perpendicular to the one direction and that passes through the fixed contact.

This configuration allows, as for a current component input from, and output to, an external device, the current component flowing through the first fixed extension to have a different amount of current from the current component flowing through the second fixed extension.

In a contact device (A1) according to a third aspect, which may be implemented in conjunction with the second aspect, the extended portion is electrically connected to the second fixed extension via the first fixed extension.

According to this configuration, when receiving a current from an external device, a current flowing out of the extended portion flows directly from the extended portion into the first fixed extension. Meanwhile, the current flowing out of the extended portion does not flow directly from the extended portion into the second fixed extension. This allows, when receiving a current from an external device, the current component flowing through the first fixed extension to have a different amount of current from the current component flowing through the second fixed extension. On the other hand, when outputting a current to an external device, the current flows directly from the first fixed extension into the extended portion. Meanwhile, the current does not flow directly from the second fixed extension into the extended portion. This allows, when outputting the current to an external device, the current component flowing through the first fixed extension to have a different amount of current from the current component flowing through the second fixed extension.

In a contact device (A1) according to a fourth aspect, which may be implemented in conjunction with any one of the first to third aspects, each of the pair of fixed terminals (12, 13) includes the contact holder. The moving contactor (10) includes a pair of moving extensions (100, 101) protruding in the one direction on both sides of the pair of moving contacts (11). At least one pair of extensions, selected from the group consisting of the pair of moving extensions (100, 101) and the respective second fixed extensions (120*b*, 130*b*) of the pair of fixed terminals (12, 13), has protrusions (e.g., a protrusion 10*a*) protruding toward the other pair of extensions.

According to this configuration, an end portion of an arc generated between the contacts moves toward the protrusions. This allows the arc generated to move, thus reducing the deterioration of the fixed and moving contacts.

In a contact device (A1) according to a fifth aspect, which may be implemented in conjunction with the fourth aspect, the protrusions are provided by bending respective end portions of the extensions such that the end portions each form an obtuse angle.

This configuration allows an arc generated between the contacts to move, in the direction in which the pair of fixed terminals are arranged, opposite from the direction leading from one fixed terminal to the other fixed terminal.

In a contact device (A1) according to a sixth aspect, which may be implemented in conjunction with any one of the first to fifth aspects, at least one pair of contacts, selected from the group consisting of the pair of moving contacts (11) and the pair of fixed contacts (14, 15), has a multi-step shape, of which a diameter decreases toward the other pair of contacts that faces the at least one pair of contacts.

This configuration allows the arc generated to move stepwise from the respective tips of the contacts toward the protrusions.

In a contact device (A1) according to a seventh aspect, which may be implemented in conjunction with the first aspect, the moving contactor (10) is configured to be displaced by turning around the one direction as an axis of rotation to move the pair of moving contacts (11) back and forth between the closed position and the open position.

This configuration lightens, even when an arc is generated in a hinged electromagnetic relay, the load on the fixed and moving contacts.

In a contact device (A1) according to an eighth aspect, which may be implemented in conjunction with the first aspect, at least one fixed terminal, selected from the pair of fixed terminals (12, 13), includes a divided portion (a first piece 12*f*, 13*f* and a second piece 12*g*, 13*g*) divided into multiple pieces and joined to an external device.

This configuration increases, when the pair of fixed terminals (12, 13) are soldered, the strength of the solder while lessening the harmful effect of the heat of molten solder.

In a contact device (A1) according to a ninth aspect, which may be implemented in conjunction with the eighth aspect, the divided portion is divided into a first piece (12*f*, 13*f*) and a second piece (12*g*, 13*g*). The first piece (12*f*, 13*f*) and the second piece (12*g*, 13*g*) have a terminal width greater than an interval between the first piece (12*f*, 13*f*) and the second piece (12*g*, 13*g*).

This configuration allows either a current flowing in from an external device or a current flowing out into an external device to have an increased current component.

An electromagnetic relay (1) according to a tenth aspect includes: the contact device (A1) according to any one of the first to ninth aspects; and an electromagnetic device (A10) including a coil (20). The moving contactor (10) is displaced depending on whether the coil (20) is exited or not.

This configuration accelerates the movement of an arc generated between the contacts, thus reducing the deterioration of the fixed and moving contacts.

An electrical device (500) according to an eleventh aspect includes: an electromagnetic relay (1); and a board (200) to mount the electromagnetic relay (1) thereon. The electromagnetic relay (1) includes: the contact device (Al) according to the eighth or ninth aspect; and an electromagnetic device (A10). The electromagnetic device (A10) includes a coil (20) and configured to displace the moving contactor (10) depending on whether the coil (20) is excited or not.

This configuration accelerates the movement of an arc generated between the contacts, thus reducing the deterioration of the fixed and moving contacts.

REFERENCE SIGNS LIST

1 Electromagnetic Relay
10 Moving contactor
10*a*, 10*b*, 10*c*, 10*d* Protrusion
11, 11*a*, 11*b* Moving contact
12, 13 Fixed Terminal
12*a*, 13*a* First Terminal Portion (Contact Holder)
12*f*, 13*f* First Piece (Divided Portion)

12*g*, 13*g* Second Piece (Divided Portion)
14, 15 Fixed Contact
20 Coil
120*a*, 130*a* First Fixed Extension
120*b*, 130*b* Second Fixed Extension
200 Board
500 Electrical device
A1 Contact Device
A10 Electromagnetic Device
I1 Current

The invention claimed is:

1. A contact device comprising:
a moving contactor;
a pair of moving contacts provided for the moving contactor and arranged side by side in one direction;
a pair of fixed terminals arranged side by side in the one direction to face the moving contactor; and
a pair of fixed contacts provided for the pair of fixed terminals, respectively,
the moving contactor being configured to move back and forth between a closed position where the pair of moving contacts are in contact with the pair of fixed contacts, respectively, and an open position where the pair of moving contacts are out of contact with the pair of fixed contacts, respectively,
at least one fixed terminal, selected from the pair of fixed terminals, including a contact holder facing the moving contactor in a direction in which the closed position and the open position are connected together,
the contact holder including:
a first fixed extension protruding, in the one direction, from the fixed contact of the one fixed terminal toward the other fixed terminal; and
a second fixed extension protruding from the fixed contact away from the other fixed terminal,
in the moving contactor, a current flowing along the one direction,
the first fixed extension including an overlapping portion,
the overlapping portion overlapping, when viewed in a direction perpendicular to the one direction, with a portion of the moving contactor through which the current flows along the one direction,
in the overlapping portion, a current flowing along the one direction, and
as for either a current component flowing in the one direction into the fixed contact or a current component flowing in the one direction out of the fixed contact, the current component flowing through the first fixed extension having a larger amount of current than a current component flowing through the second fixed extension.

2. The contact device of claim 1, wherein
the fixed terminal with the contact holder, out of the pair of fixed terminals, includes an extended portion which is arranged in a direction intersecting with the one direction with respect to the contact holder and which is connected to a member to be connected to an external device, and
the extended portion is coupled to the contact holder asymmetrically with respect to an axis that is perpendicular to the one direction and that passes through the fixed contact.

3. The contact device of claim 2, wherein the extended portion is electrically connected to the second fixed extension via the first fixed extension.

4. The contact device of claim 1, wherein
each of the pair of fixed terminals includes the contact holder,
the moving contactor includes a pair of moving extensions protruding in the one direction on both sides of the pair of moving contacts,
at least one pair of extensions, selected from the group consisting of the pair of moving extensions and the respective second fixed extensions of the pair of fixed terminals, has protrusions protruding toward the other pair of extensions.

5. The contact device of claim 4, wherein the protrusions are provided by bending respective end portions of the extensions such that the end portions each form an obtuse angle.

6. The contact device of claim 1, wherein at least one pair of contacts, selected from the group consisting of the pair of moving contacts and the pair of fixed contacts, has a multi-step shape, of which a diameter decreases toward the other pair of contacts that faces the at least one pair of contacts.

7. The contact device of claim 1, wherein the moving contactor is configured to be displaced by turning around the one direction as an axis of rotation to move the pair of moving contacts back and forth between the closed position and the open position.

8. The contact device of claim 1, wherein at least one fixed terminal, selected from the pair of fixed terminals, includes a divided portion divided into multiple pieces and joined to an external device.

9. The contact device of claim 8, wherein the divided portion is divided into a first piece and a second piece, the first piece and the second piece having a terminal width greater than an interval between the first piece and the second piece.

10. An electrical device comprising:
an electromagnetic relay; and
a board to mount the electromagnetic relay thereon,
the electromagnetic relay including:
the contact device of claim 8; and
an electromagnetic device including a coil and configured to displace the moving contactor depending on whether the coil is excited or not.

11. An electromagnetic relay comprising:
the contact device of claim 1; and
an electromagnetic device including a coil,
the moving contactor being displaced depending on whether the coil is exited or not.

12. A contact device comprising:
a moving contactor;
a pair of moving contacts provided for the moving contactor and arranged side by side in one direction;
a pair of fixed terminals arranged side by side in the one direction to face the moving contactor; and
a pair of fixed contacts provided for the pair of fixed terminals, respectively,
the moving contactor being configured to move back and forth between a closed position where the pair of moving contacts are in contact with the pair of fixed contacts, respectively, and an open position where the pair of moving contacts are out of contact with the pair of fixed contacts, respectively,
at least one fixed terminal, selected from the pair of fixed terminals, including:
a contact holder facing the moving contactor in a direction in which the closed position and the open position are connected together, an extended portion which is arranged in a direction intersecting with the one direction with respect to the contact holder and which is connected to a member to be connected to an external device, a connecting terminal portion connecting the contact holder and the extended portion, and a cutout portion, the contact holder including:

a first fixed extension protruding, in the one direction, from the fixed contact of the one fixed terminal toward the other fixed terminal; and a second fixed extension protruding from the fixed contact away from the other fixed terminal, the cutout portion is located in between the second fixed extension and the extended portion, and as for either a current component flowing in the one direction into the fixed contact or a current component flowing in the one direction out of the fixed contact, the current component flowing through the first fixed extension having a larger amount of current than a current component flowing through the second fixed extension.

* * * * *